US005182037A

United States Patent [19]

Pialet et al.

[11] Patent Number: 5,182,037

[45] Date of Patent: Jan. 26, 1993

[54] PHOSPHORUS- AND/OR NITROGEN-CONTAINING DERIVATIVES OF SULFUR-CONTAINING COMPOUNDS, LUBRICANT, FUEL AND FUNCTIONAL FLUID COMPOSITIONS

[75] Inventors: Joseph W. Pialet, Euclid; Curtis R. Scharf, Wickliffe; Stephen A. DiBiase, Euclid, all of Ohio

[73] Assignee: The Lubrizol Corporation, Wickliffe, Ohio

[21] Appl. No.: 928,494

[22] Filed: Nov. 7, 1986

[51] Int. Cl.[5] ..... C10L 1/18; C10L 1/22; C10M 159/12

[52] U.S. Cl. ..... 252/47.5; 44/376; 44/384; 44/386; 252/48.2; 252/48.6

[58] Field of Search ..... 252/47.5, 48.2, 48.6; 44/376, 384, 386

[56] References Cited

U.S. PATENT DOCUMENTS

| | | | |
|---|---|---|---|
| Re. 27,331 | 4/1972 | Coleman | 252/47.5 |
| 2,579,810 | 12/1951 | Fields | 260/461.1 |
| 2,580,695 | 1/1951 | Niederhauser | 568/22 |
| 2,593,213 | 4/1952 | Stiles | 260/461 |
| 3,296,137 | 1/1967 | Wiese | 252/48.2 |
| 3,817,928 | 6/1974 | Hayashi | 560/154 X |
| 4,119,549 | 10/1978 | Davis | 252/45 |
| 4,191,659 | 3/1980 | Davis | 252/45 |
| 4,248,723 | 2/1981 | Schmidt | 252/48.6 |

*Primary Examiner*—Jacqueline V. Howard

[57] ABSTRACT

This invention is directed to phosphorus and/or nitrogen-containing derivative compositions of sulfur containing compounds which are suitable particularly for use as additives for lubricants, fuels and functional fluids. The lubricants, fuels, and/or functional fluids containing the derivatives of this invention exhibit improved anti-wear, extreme pressure and antioxidant properties.

71 Claims, No Drawings

PHOSPHORUS- AND/OR NITROGEN-CONTAINING DERIVATIVES OF SULFUR-CONTAINING COMPOUNDS, LUBRICANT, FUEL AND FUNCTIONAL FLUID COMPOSITIONS

TECHNICAL FIELD OF THE INVENTION

This invention relates to new phosphorus- and/or nitrogen-containing derivatives of certain sulfur compounds which are suitable particularly for use as additives for lubricants, fuels and functional fluids. Lubricants, fuels and/or functional fluids containing the novel derivatives of this invention exhibit improved anti-wear, extreme pressure and antioxidant properties. The functional fluids may be hydrocarbon-based or aqueous-based. The invention also relates to lubricating compositions which may be lubricating oils and greases useful in industrial applications and in automotive engines, transmissions and axles.

BACKGROUND OF THE INVENTION

Compositions prepared by the sulfurization of various organic materials including olefins are known in the art, and lubricants containing these compositions also are known. U.S. Pat. No. 4,191,659 describes the preparation of sulfurized olefinic compounds by the catalytic reaction of sulfur and hydrogen sulfide with olefinic compounds containing from 3 to 30 carbon atoms. The compounds are reported to be useful in lubricating compositions, particularly those prepared for use as industrial gear lubricants. U.S. Pat. No. 4,119,549 describes a similar procedure for sulfurizing olefins utilizing sulfur and hydrogen sulfide followed by removal of low boiling materials from said sulfurized mixture.

Sulfur-containing compositions characterized by the presence of at least one cycloaliphatic group with at least two nuclear carbon-atoms-of one cycloaliphatic group or two .nuclear carbon atoms of different cycloaliphatic groups joined together through a divalent sulfur linkage are described in Reissue Patent Re U.S. Pat. No. 27,331. The sulfur linkage contains at least two sulfur atoms, and sulfurized Diels-Alder adducts are illustrative of the compositions disclosed in the reissue patent. The sulfur-containing compositions are useful as extreme pressure and anti-wear additives in various lubricating oils.

The lubricant compositions described in Re U.S. Pat. No. 27,331 may contain other additives normally used in lubricating oils such as detergents, dispersants, other extreme pressure agents, oxidation- and corrosion-inhibitors, etc. Among the extreme pressure additives described are organic sulfides and polysulfides such as benzylsulfide and phosphosulfurized hydrocarbons; phosphorus esters such .as dihydrocarbon and trihydrocarbon phosphites including, .for example, dibutyl phosphite, pentylphenyl phosphite, tridecyl phosphite and dipentylphenyl phosphite, etc.

Dialdehydes containing disulfide groups and represented by the formula

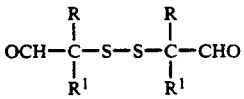

wherein both R groups are the same alkyl groups of 1 to 18 carbon atoms and both $R^1$ groups are the same alkyl or aryl groups are described in U.S. Pat. No. 2,580,695. The compounds are reported to be useful as cross-linking agents and as chemical intermediates.

Lubricating compositions containing sulfides having the formula

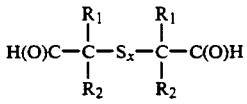

wherein $R_1$ is a hydrocarbon group, $R_2$ is hydrogen or a hydrocarbon group, and x is 1 to 2 are described in U.S. Pat. No. 3,296,137. The lubricants can contain other additives including, for example, detergents of the ash-containing type, viscosity index-improving agents, extreme-pressure agents, oxidation-inhibiting agents, friction-improving agents, corrosion-inhibiting and oxidation-inhibiting agents described in the patent are organic sulfides and polysulfides such as benzylsulfide and phosphosulfurized hydrocarbons; phosphorus esters such as dihydrocarbon and trihydrocarbon phosphites including, for example, dibutyl phosphite, pentylphenyl phosphite, tridecyl phosphite and dipentylphenyl phosphite, etc.

U.S. Pat. No. 3,817,928 describes the preparation of hydroxy-terminated polyesters of thia-bisaldehydes. The derivatives are prepared by reacting a thia-bisaldehyde with another reagent such as alcohol, organometallic compound or metal base. The derivatives are useful for industrial purposes such as in the preparation of polyurethanes. The thia-bisaldehydes which are utilized as starting materials in the '928 patent are similar to the thia-bisaldehydes described in the above-identified Reissue Patent Re U.S. Pat. No. 27,331. Hydroxy-acid derivatives of the thia-bisaldehydes are described as having the formula

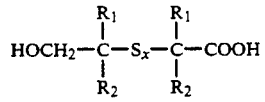

wherein $R_1$, $R_2$ and x are as defined above. The hydroxy acids can be converted to other derivatives such as lactones by intramolecular condensation in the presence of acetic anhydride or to amides by reaction with aqueous ammonia.

U.S. Pat. No. 4,248,723 describes the preparation of acetal and thioacetal derivatives of thia-bisaldehydes similar to the thia-bisaldehydes described above. The acetal and thioacetal derivatives are prepared by reacting the thia-bisaldehydes with compounds represented by the formula $$R_3XH$$

wherein $R_3$ is a $C_{1-18}$ alkyl, $C_{6-18}$ aryl, etc. group, and X is oxygen or sulfur. The acetal derivatives are useful as extreme pressure additives for lubricants.

The reaction of aldehydes with phosphites is described in U.S. Pat. No. 2,579,810, and the reaction of aldehydes with phosphites is described in U.S. Pat. No. 2,593,213. Reactions of aldehydes with amines and phosphites as well as reactions of imines with phosphites are described in *J. Am. Chem. Soc.*, 74, 1528–31 (1952).

SUMMARY OF THE INVENTION

This invention is directed to novel phosphorus- and/or nitrogen-containing derivatives of certain organic sulfur compounds. The derivatives are useful as additives in lubricants and functional fluids, fuels and aqueous systems. Lubricating, fuel and functional fluid compositions containing the derivatives of the invention exhibit improved antioxidant, anti-wear and/or extreme-pressure properties.

The phosphorus- and/or nitrogen-containing derivative compositions of the invention are prepared by the process which comprises reacting (A) at least one sulfur composition from the group of (A-1) compounds characterized by the structural formula

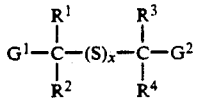

(I)

wherein $R^1$, $R^2$, $R^3$, $R^4$, $G^1$ and $G^2$ and x are as defined hereinafter; and (A-2) compositions prepared by reacting sulfur and/or sulfur halides with compounds represented by the structural formulae

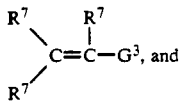

(II)

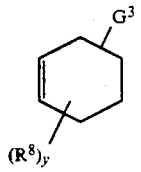

(III)

wherein $R^7$, $R^8$, $G^3$ and y are as defined hereinafter; with (B) a di- or trihydrocarbyl phosphite, at least one amine compound containing at least one NH or $NH_2$ group, or a combination of said phosphite and amine, provided, however, when $G^1$ and $G^2$ in (A-1) are —C(X)R, (B) is a di- or tri-hydrocarbylphosphite or a mixture of said phosphite and an amine compound containing at least one NH or $NH_2$ group.

DESCRIPTION OF THE PREFERRED EMBODIMENTS

(A): Sulfur Compositions

The sulfur compositions which are reacted with the phosphite and/or amines in accordance with the present invention may be (A-1) compounds characterized by the structural formula

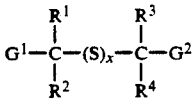

(I)

wherein $R^1$, $R^2$, $R^3$ and $R^4$ are each independently H or hydrocarbyl groups;

$R^1$ and/or $R^3$ may be $G^1$ or $G^2$;

$R^1$ and $R^2$ and/or $R^3$ and $R^4$ together may be alkylene groups containing about 4 to about 7 carbon atoms;

$G^1$ and $G^2$ are each independently C(X)R, COOR, C≡N, $R^5$—C═$NR^6$, $CON(R)_2$, or $NO_2$, and $G^1$ may be $CH_2OH$, wherein X is O or S, each of R and $R^5$ are independently H or a hydrocarbyl group, $R_6$ is H or a hydrocarbyl group;

when both $G^1$ and $G^2$ are $R^5C$═$NR^6$, the two $R^6$ groups together may be a hydrocarbylene group linking the two nitrogen atoms;

when $G^1$ is $CH_2OH$ and $G^2$ is COOR, a lactone may be formed by intramolecular combination of $G^1$ and $G^2$; and x is an integer from 1 to about 8.

$R^1$, $R^2$, $R^3$ and $R^4$ in Formula I are each independently hydrogen or hydrocarbyl groups. The hydrocarbyl groups may be aliphatic or aromatic groups such as alkyl, cycloalkyl, alkaryl, aralkyl or aryl groups. $R^1$ and $R^2$ and/or $R^3$ and $R^4$ together may be alkylene groups containing from about 4 to about 7 carbon atoms. In these embodiments, $R^1$ and $R^2$ together with the carbon atom bonded to $R^1$ and $R^2$ in Formula I will form a cycloalkyl group. Similarly, $R^3$ and $R^4$ together with the carbon atom bonded to $R^3$ and $R^4$ will form a cycloalkyl group. Also, $R^1$ and/or $R^3$ may be $G^1$ or $G^2$.

The hydrocarbyl groups $R^1$, $R^2$, $R^3$ and $R^4$ usually will contain up to about 30 carbon atoms. Preferably, the hydrocarbyl groups are alkyl groups containing up to about 10 carbon atoms. Specific examples of hydrocarbyl groups include methyl, ethyl, isopropyl, isobutyl, secondary butyl, cyclohexyl, cyclopentyl, octyl, dodecyl, octadecyl, eicosyl, behenyl, triacontonyl, phenyl, naphthyl, phenethyl, octyl-phenyl, tolyl, xylyl, dioctadecyl-phenyl, triethyl-phenyl, chloro-phenyl, methoxy-phenyl, dibromo-phenyl, nitrophenyl, 3-chlorohexyl, etc. As used in the specification and claims, the term "hydrocarbyl group" is intended to include groups which are substantially hydrocarbon in character. Thus, the hydrocarbyl groups include groups which may contain a polar substituent such as chloro, bromo, nitro, ether, etc., provided that the polar substituent is not present in proportions so as to alter significantly the hydrocarbon character of the group. In most instances, there should be no more than one polar substituent in each group.

The sulfur compounds of the present invention as represented by Formula I may be thia-aldehydes or thia-ketones. That is, $G^1$ and $G^2$ in Formula I are C(O)R groups. Various thia-bisaldehyde compounds are known, and the synthesis of such compounds have been described in the prior art such as in U.S. Pat. Nos. 3,296,137 and 2,580,695. Thia-aldehydes and thia-ketones are most conveniently prepared by the sulfurization of a suitable aldehyde or ketone such as one having the structural formula $$R^1R^2CHC(O)R$$

wherein $R^1$ is hydrogen, hydrocarbyl groups or C(O)R, $R^2$ is hydrogen or a hydrocarbyl group, and R is hydrogen or a hydrocarbyl group. In these instances, $R^3$ and $R^4$ in Formula I will be the same as $R^1$ and $R^2$, respectively, and both $G^1$ and $G^2$ are C(O)R groups. When $R^1$ is C(O)R, the sulfurization product contains four C(O)R groups.

The sulfurization can be accomplished by reacting the aldehyde or ketone with a sulfur halide such as sulfur monochloride (i.e., $S_2Cl_2$), sulfur dichloride, sulfur monobromide, sulfur dibromide, and mixtures of sulfur halide with sulfur flowers in varying amounts.

The reaction of an aldehyde or ketone with a sulfur halide may be effected simply by mixing the two reactants at the desired temperature which may range from about −30° C. to about 250° C. or higher. The preferred reaction temperature generally is within the range of from about 10° to about 80° C. The reaction may be carried out in the presence of a diluent or solvent such as benzene, naphtha, hexane, carbon tetrachloride, chloroform, mineral oil, etc. The diluent/solvent facilitates the control of the reaction temperature and a thorough mixing of the reactants.

The relative amounts of the aldehyde or ketone and the sulfur halide may vary over wide ranges. In most instances, the reaction involves two moles of the aldehyde or ketone and one mole of the sulfur halide. In other instances, an excess of either one of the reactants may be used. When sulfur compounds are desired which contain more than two sulfur atoms, (e.g., x is an integer from 3–8) these compounds can be obtained by reacting the aldehydes with a mixture of sulfur halide and sulfur. Sulfurization products wherein $G^1$ and $G^2$ are different and may be obtained by sulfurizing mixtures of aldehydes and ketones or mixtures of ketones containing different C(O)R groups.

Specific examples of thia-aldehydes and thia-ketones include compounds as represented by Formula I wherein $G^1$ and $G^2$ are C(O)R groups, x is 1 to 4 and $R^1$, $R^2$, $R^3$, $R^4$ and R are as follows:

| $R^1$ | $R^2$ | $R^3$ | $R^4$ | R |
|---|---|---|---|---|
| $CH_3$ | H | $CH_3$ | H | H |
| $CH_3$ | $CH_3$ | $CH_3$ | $CH_3$ | $CH_3$ |
| $C_{25}$ | H | $C_2H_5$ | H | H |
| $CH_3C(O)$— | H | $CH_3C(O)$— | H | $CH_3$ |
| $CH_3C(O)$— | H | $CH_3C(O)$— | H | H |
| $C_2H_5$ | $C_4H_{11}$ | $C_2H_5$ | $C_4H_{11}$ | H |

The thia-aldehydes and thia-ketones which can be prepared as described above can be converted to derivatives containing other functional groups which are normally derivable therefrom. Thus, in some of the embodiments of the invention, a thia-aldehyde or thia-ketone is converted to a derivative through contemporneous conversion of the aldehyde or ketone groups to other terminal groups by chemical reactants and/or reagents. In such reactions, the thia group ($S_x$) and the $R^1$–$R^4$ groups are inert and remain unchanged in the compound. For example, the thia-bisaldehydes can be converted to hydroxy-acid derivatives wherein one of the aldehyde groups ($G^1$) is converted to a COOH group, and the other aldehyde group ($G^2$) is converted to a $CH_2OH$ group. The hydroxy-acid derivatives are obtainable most conveniently by treating the corresponding thia-bisaldehyde with an alkaline reagent such as an alkali metal hydroxide or alkaline earth metal hydroxide, preferably a dilute aqueous solution thereof containing from about 5 to about 50% by weight of the hydroxide in water. Such alkaline reagents may be sodium hydroxide, potassium hydroxide, lithium hydroxide, barium hydroxide, calcium hydroxide, strontium hydroxide, etc. The hydroxy-acid is isolated from the reaction mixture by acidification with a mineral acid such as hydrochloric acid. The hydroxy-acid derivatives of thia-bisaldehydes can be represented by Formula Ia below.

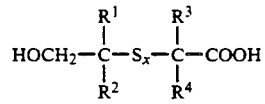

(Ia)

wherein $R^1$, $R^2$, $R^3$, $R^4$ and x are as previously defined. Specific examples of such hydroxy-acid derivatives include 6-hydroxy-2,2,5,5-tetramethyl-3,4-dithiahexanoic acid (i.e., conforming to Formula Ia wherein $R^1$, $R^2$, $R^3$ and $R^4$ are methyl and x is 2); 6-hydroxy-2,2-diethyl-5-propyl-5-butyl-3,4-dithiahexanoic acid; 6-hydroxy-2,2,5,5-tetraethyl-3,4-dithiahexanoic acid; etc.

By virtue of the presence of the hydroxy group and the carboxylic group in the hydroxy-acids described by Formula Ia above, various other sulfur-containing compounds useful in the present invention can be obtained by the conversion of such hydroxy group and/or the carboxylic group to other polar groups normally derivable therefrom. Examples of such derivatives include esters formed by esterification of either or both of the hydroxy group and the carboxylic group; amides, imides, and acyl halides formed through the carboxylic group; and lactones formed through intramolecular cyclization of the hydroxy-acid accompanied with the elimination of water. The procedures for preparing such derivatives are well known to those skilled in the art, and it is not believed necessary to unduly lengthen the specification by including a detailed description of such procedures. More specifically, the carboxylic group (COOH) in Formula Ia can be converted to ester groups (COOR) and amide groups ($CON(R)_2$) wherein the R groups may be hydrogen or hydrocarbyl groups containing from 1 to 30 carbon atoms and more generally from 1 to about 10 carbon atoms. Specific examples of such R groups include ethyl, propyl, butyl, phenyl, etc.

The procedures for preparing lactones through intramolecular cyclization of hydroxy-acids of Formula Ia accompanied by the elimination of water are well known in the art. Generally, the cyclization is promoted by the presence of materials such as acetic anhydride, and the reaction is effected by heating the mixtures to elevated temperatures such as the reflux temperature while removing volatile materials including water.

The sulfur compounds characterized by structural Formula I wherein $G^1$ and/or $G^2$ are $R^5C{=}NR^6$ can be prepared from the corresponding thia-aldehydes and thia-ketones. These mono- and di-imine compounds are prepared by reacting one mole of the dialdehyde (C(O)H) or diketone ($C(O)R^5$) with one and two moles of an amine, respectively. The amines may be monoamines or polyamines. When polyamines are reacted with the thia-aldehydes or thia-ketones [—$C(O)R^5$], cyclic di-imines can be formed. For example, when both $G^1$ and $G^2$ in Formula I are $R^5C{=}NR^6$, the two $R^6$ groups together may be a hydrocarbylene group linking the two nitrogen atoms. The amines which are reacted with the thia-aldehydes and thia-ketones to form the imines may be characterized by the formula $R^6NH_2$ wherein $R^6$ is hydrogen, or hydrocarbyl, or an amino hydrocarbyl group. Generally, the hydrocarbyl groups will contain up to about 30 carbon atoms and will more often be aliphatic hydrocarbyl groups containing from 1 to about 30 carbon atoms.

In one preferred embodiment, the hydrocarbyl amines which are useful in preparing the imine derivatives of the present invention are primary hydrocarbyl amines containing from about 2 to about 30 carbon atoms in the hydrocarbyl group, and more preferably from about 4 to about 20 carbon atoms in the hydrocarbyl group. The hydrocarbyl group may be saturated or unsaturated. Representative examples of primary saturated amines are the lower alkyl amines such as methyl amine, ethyl amine, n-propyl amine, n-butyl amine, n-amyl amine, n-hexyl amine; those known as aliphatic primary fatty amines and commercially known as "Armeen" primary amines (products available from Armak Chemicals, Chicago, Illinois). Typical fatty amines include alkyl amines such as n-hexylamine, n-octylamine, n-decylamine, n-dodecylamine, n-tetradecylamine, n-pentadecylamine, n-hexadecylamine, n-octadecylamine (stearyl amine), etc. These Armeen primary amines are available in both distilled and technical grades. While the distilled grade will provide a purer reaction product, the desirable amides and imides will form in reactions with the amines of technical grade. Also suitable are mixed fatty amines such as Armak's Armeen-C, Armeen-O, Armeen-OL, Armeen-T, Armeen-HT, Armeen S and Armeen SD.

In another preferred embodiment, the amine salts of the composition of this invention are those derived from tertiary-aliphatic primary amines having at least about 4 carbon atoms in the alkyl group. For the most part, they are derived from alkyl amines having a total of less than about 30 carbon atoms in the alkyl group.

Usually the tertiary aliphatic primary amines are monoamines represented by the formula

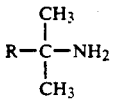

wherein R is a hydrocarbyl group containing from one to about 30 carbon atoms. Such amines are illustrated by tertiary-butyl amine, tertiary-hexyl primary amine, 1-methyl-1-amino-cyclohexane, tertiary-octyl primary amine, tertiary-decyl primary amine, tertiary-dodecyl primary amine, tertiary-tetradecyl primary amine, tertiary-hexadecyl primary amine, tertiary-octadecyl primary amine, tertiary-tetracosanyl primary amine, tertiary-octacosanyl primary amine.

Mixtures of amines are also useful for the purposes of this invention. Illustrative of amine mixtures of this type are "Primene 81R" which is a mixture of $C_{11}$–$C_{14}$ tertiary alkyl primary amines and "Primene JM-T" which is a similar mixture of $C_{18}$–$C_{22}$ tertiary alkyl primary amines (both are available from Rohm and Haas Company). The tertiary alkyl primary amines and methods for their preparation are well known to those of ordinary skill in the art and, therefore., further discussion is unnecessary. The tertiary alkyl primary amine useful for the purposes of this invention and methods for their preparation are described in U.S. Pat. No. 2,945,749 which is hereby incorporated by reference for its teaching in this regard.

Primary amines in which the hydrocarbon chain comprises olefinic unsaturation also are useful. Thus, the $R^6$ group may contain one or more olefinic unsaturation depending on the length cf the chain, usually no more than one double bond per 10 carbon atoms. Representative amines are dodecenylamine, myristoleylamine, palmitoleylamine, oleylamine and linoleylamine. Such unsaturated amines also are available under the Armeen tradename.

The thia-aldehydes and thia-ketones also can be reacted with polyamines. Examples of useful polyamines include diamines such as mono- or dialkyl, symmetrical or asymmetrical ethylene diamines, propane diamines (1,2, or 1,3), and polyamine analogs of the above. Suitable commercial fatty polyamines are "Duomeen C" (N-coco-1,3-diaminopropane), "Duomeen S" (N-soya-1,3-diaminopropane), "Duomeen T" (N-tallow-1,3-diaminopropane), or "Duomeen 0"(N-oleyl-1,3-diaminopropane). "Duomeens" are commercially available diamines described in Product Data Bulletin No. 7-10R1 of Armak Chemical Co., Chicago, Illinois.

The reaction of thia-aldehydes (and ketones) with primary amines or polyamines can be carried out by techniques well known to those skilled in the art. Generally, the thia-bisaldehyde or ketone is reacted with the amine or polyamine by reaction in a hydrocarbon solvent at an elevated temperature, generally in an atmosphere of nitrogen. As the reaction proceeds, the water which is formed is removed such as by distillation.

Sulfur compounds characterized by structural Formula I wherein $G^1$ and $G^2$ may be COOR, C═N and $NO_2$ can be prepared by the reaction of compounds characterized by the structural formula

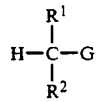

(IV)

wherein $R^1$ and $R^2$ are as defined above, and G is COOR, C≡N or $NO_2$, or mixtures of different compounds represented by Formula IV with a sulfur halide or a mixture of sulfur halides and sulfur. Generally, about one mole of sulfur halide is reacted with about two moles of the compounds represented by Formula IV. In one embodiment, $R^1$ also may G. In such instances, the sulfur compounds which are formed as a result of the reaction with the sulfur halide will contain four G groups which may be the same or different depending upon the starting material. For example, when a di-ketone such as 2,4-pentanedione is reacted with sulfur monochloride, the resulting product contains four ketone groups; when the starting material contains a ketone group and an ester group (e.g., ethylacetoacetate), the resulting product contains two ketone groups and two ester groups; and when the starting material contains two ester groups (e.g., diethylmalonate), the product contains four ester groups. Other combinations of functional groups can be introduced into the sulfur products utilized in the present invention and represented by, Formula I by selecting various starting materials containing the desired functional groups.

Sulfur compounds represented by Formula I wherein $G^1$ and/or $G^2$ are C≡N groups can be prepared by the reaction of compounds represented by Formula IV wherein G is C≡N and $R^1$ and $R^2$ are hydrogen or hydrocarbyl groups. Preferably, $R^1$ is hydrogen and $R^2$ is a hydrocarbyl group. Examples of useful starting materials include, for example, propionitrile, butyronitrile, etc.

Compounds of Formula I wherein $G^1$ and $G^2$ are $NO_2$ groups can be prepared by (1) reacting a nitro hydrocarbon $R^1R^2C(H)NO_2$ with an alkali metal or alkaline earth metal alkoxide to form the salt of the nitro hydrocarbon, and (2) reacting said salt with sulfur monochloride in an inert, anhydrous nonhydroxylic medium to form a bis (1-nitrohydrocarbyl) disulfide. Preferably the nirto hydrocarbon is a primary nitro hydrocarbon ($R^1$ is hydrogen and $R^2$ is hydrocarbyl).

The starting primary nitro compounds used in carrying out this synthesis are well known. Illustrative compounds are nitroethane, 1-nitropropane, 1-nitrobutane, 1-nitro-4-methylhexane, (2-nitroethyl) benzene, etc.

The nature of the alkanol used in obtaining the alkali or alkaline earth metal salt of the starting primary nitro compound is not critical. It is only necessary that it be appropriate for reaction with the metal to form the alkoxide. Because they are easily obtainable and inexpensive, the lower alkanols (i.e., alkanols of 1 to 4 carbon atoms) such as methanol, ethanol and butanol will usually be employed in the synthesis.

The medium in which the salt is reacted with $S_2Cl_2$ must be inert to both the reactants. It is also essential that the medium be anhydrous and nonhydroxylic for the successful formation of the novel bis(1-nitrohydrocarbyl) disulfides. Examples of suitable media are ether, hexane, benzene, dioxane, higher alkyl ethers, etc.

Ordinarily, it is preferable to maintain a temperature of about 0°-10° C. during the preparation of the metal salt. However, temperatures from about 0° to 25° C. may be used in this step of the process. In the preparation of the bisdisulfide temperatures in the range of −5 to +15° C. may be used. Preferably, temperatures between about 0° to 5° C. are used in this step of the process.

The preparation of various thia-bisnitro compounds useful as reactant (A-1) in the present invention is described in some detail in U.S. Pat. No. 3,479,413, and the disclosure of this patent is hereby incorporated by reference. Representative examples of nitro sulfides useful in the present invention are: bis(1-nitro-2-phenylethyl) disulfide, bis(1-nitrodecyl) disulfide, bis(1-nitrododecyl) disulfide, bis(1-nitro-2-phenyldecyl) disulfide, bis(1-nitro-2-cyclohexylethyl) disulfide, bis(1-nitropentadecyl) disulfide, bis(1-nitro-3-cyclobutylpropyl) disulfide bis(1-nitro-2-naphthylethyl) disulfide, bis(1-nitro-3-p-tolylpropyl) disulfide, bis(1-nitro-2-cyclooctylethyl) disulfide, and the like.

The carboxylic ester-containing sulfur compounds (i.e., $G^1$ is COOR) described above can be utilized to prepare other sulfur compounds useful as reactant (A-1) in the present invention. For example, the ester (COOR) can be hydrolyzed to the carboxylic acid (COOH). which can be converted to other esters by reaction with various alcohols or to amides by reaction with various amines including ammonia in primary or secondary amines such as those represented by the formula $$(R)_2NH$$

wherein each R is hydrogen or a hydrocarbyl group. These hydrocarbyl groups may contain from 1 to about 30 carbon atoms and more generally will contain from about 1 to 10 carbon atoms.

As mentioned above, $R^1$ and $R^2$ and/or $R^3$ and $R^4$ together may be alkylene groups containing from about 4 to about 7 carbon atoms. In this embodiment, $R^1$ and $R^2$ (and $R^3$ and $R^4$) form a cyclic compound with the common carbon atom (i.e., the carbon atom which is common to $R^1$ and $R^2$ in Formula I. Such derivatives of structural Formula I can be prepared by reacting the appropriately substituted saturated cyclic material with sulfur halides as described above. Examples of such cyclic starting materials include cyclohexane carboxaldehyde ($C_6H_{11}CHO$), cyclohexane carbonitrile ($C_6H_{11}CN$), cyclohexane carboxamide ($C_6H_{11}CONH_2$), cyclohexane carboxylic acid ($C_6H_{11}COOH$), cyclobutane carboxylic acid ($C_4H_7COOH$), cycloheptane carboxylic acid ($C_7H_{13}COOH$), cycloheptyl cyanide ($C_7H_{13}CN$), etc.

The following Examples A-1-1 to A-1-20 illustrate the preparation of the sulfur compositions represented by Formula I. Unless otherwise indicated in the examples and elsewhere in this specification and claims, all parts and percentages are by weight, and all temperatures are in degrees centigrade.

Example A-1-1

Sulfur monochloride (1620 parts, 12 moles) is charged to a 5-liter flask and warmed under nitrogen to a temperature of about 53° C. whereupon 1766 parts (24.5 moles) of isobutyraldehyde are added dropwise under nitrogen at a temperature of about 53°-60° C. over a period of about 6.5 hours. After the addition of the isobutyraldehyde is completed, the mixture is heated slowly over a period of 6 hours to a temperature of about 100° C. while blowing with nitrogen. The mixture is maintained at 100° C. with nitrogen blowing for a period of about 6 hours and volatile materials are removed from the reaction vessel. The reaction product then is filtered through a filter aid, and the filtrate is the desired product containing 31.4% sulfur (theory, 31.08%). The desired reaction product, predominantly 2,2'-dithiodiisobutyraldehyde, is recovered in about 95% yield.

Example A-1-2

Sulfur monochloride (405 parts, 3 moles) is charged to a 2-liter flask and warmed to about 50° C. under nitrogen whereupon 769.2 parts (6 moles) of 2-ethylhexanal are added dropwise. After about 45 minutes of addition, the reaction mixture exotherms to about 65° C. The addition of the remaining aldehyde is continued at about 55° C. over a period of about 5 hours. After allowing the mixture to stand overnight, the mixture is heated slowly to 100° C. and maintained at this temperature. Additional 2-ethylhexanal (20 parts) is added, and the mixture is maintained at 100° C. while blowing with nitrogen. The reaction mixture is stripped to 135° C./10 mm. Hg. and filtered through a filter aid. The filtrate is the desired product containing 19.9% sulfur (theory,, 20.09).

Example A-1-3

Sulfur monochloride (270 parts, 2 moles) and 64 parts (2 moles) of sulfur are charged to a 1-liter flask and heated to 100° C. for 3 hours. The mixture is cooled to about 50° C. whereupon 288.4 parts (4 moles) of isobutyraldehyde are added dropwise under nitrogen at about 50°-57° C. After all of the aldehyde is added, the mixture is heated to 100° C. and maintained at this temperature for about one day under nitrogen. The reaction mixture is cooled to room temperature and filtered through a filter aid. The filtrate is the desired product containing 38% sulfur (theory, 31.5–40.3% for a di- and tri-sulfide product).

Example A-1–4

Sulfur monochloride (270 parts, 2 moles) and sulfur (96 parts, 3 moles) are charged to a 1-liter flask and heated to 125° C. After maintaining the mixture at this temperature for several hours, the mixture is cooled to 50° C., and 288.4 parts (4 moles) of isobutyraldehyde are added while blowing with nitrogen. The reaction temperature is maintained at about 55° C., and the addition of the isobutyraldehyde is completed in about 4 hours. The mixture is heated to 100° C. while blowing with nitrogen and maintained at this temperature for several hours. The mixture is filtered, and the filtrate is the desired product containing 40.7% sulfur indicating the product to be a mixture of di-, tri- and possibly tetra-sulfide product.

Example A-1-5

Sulfur dichloride (257.5 parts, 2.5 moles) is charged to a 1-liter flask and warmed to 40° C. under nitrogen whereupon 360.5 parts (5 moles) of isobutyraldehyde are added dropwise while maintaining the reaction temperature at about 40°–45° C. The addition of the isobutyraldehyde requires about 6 hours, and the reaction initially is exothermic. The reaction mixture is maintained at room temperature overnight. After maintaining the reaction mixture at 50° C. for one hour while blowing with nitrogen, the mixture is heated to 100° C. while collecting volatile materials. An additional 72 parts of isobutyraldehyde is added, and the mixture is maintained at 100° C. for 4 hours, stripped, and filtered through filter aid. The filtrate is the desired product containing 24% sulfur indicating that the product is a mixture of the mono- and di-sulfide products.

Example A-1-6

Methanol (500 parts) is charged to a 1-liter flask, and 23 parts-(1 mole) of sodium are added slowly in a nitrogen atmosphere.- The mixture is cooled in an ice bath to about 5°–10° C. whereupon 89 parts (1 mole) of 1-nitropropane are added dropwise. The reaction mixture is filtered, and the solids are washed with ether. A slurry is prepared of the solids in ether, and the slurry is cooled to 0°–5° C. whereupon 67.5 parts (0.5 mole) of sulfur monochloride are added dropwise under nitrogen over a period of about 2.5 hours. An additional 200 parts of ether are added, and the mixture is filtered. The ether layer is washed with ice water and dried over magnesium sulfate. Evaporation of the ether yields the desired product containing 9.24% nitrogen and 38% sulfur.

Example A-1-7

Sodium hydroxide (240 parts, 6 moles) is dissolved in water, and the solution is cooled to room temperature whereupon 824 parts (4 moles) of 2,2'-dithiodiisobutyraldehyde prepared as in Example A-1-1 are added over a period of about 0.75 hour. The reaction mixture exotherms to about 53° C., and after stirring for about 3 hours, the reaction mixture is extracted three times with 500 parts of toluene. The aqueous layer is cooled in an ice bath to about 7° C., and 540 parts of concentrated hydrochloric acid are added slowly at a temperature below about 10° C. A white solid forms in the reaction vessel, and the mixture is filtered. The solid is washed with ice water and dried. The solid material is the desired product containing 27.1% sulfur (theory, 28.6%).

Example A-1-8

Methyl isobutyl ketone (300.6 parts, 3 moles) is charged to a 1-liter flask and heated to 60° C. whereupon 135 parts (1 mole) of sulfur monochloride are added dropwise under nitrogen over a period of about 4 hours. The reaction mixture is maintained at about 60°–70° C. during the addition, and when all of the sulfur monochloride has been added, the material is blown with nitrogen while heating to 105° C. The mixture is maintained at 105°–110° C. for several hours while collecting volatile materials. After stripping to 95° C. at reduced pressure, the reaction mixture is filtered at room temperature through a filter aid and the filtrate is the desired product containing 30.1% sulfur (theory, 24.4%).

Example A-1-9

A mixture of 400 parts (4 moles) of 2,4-pentanedione and 800 parts of ethyl acetate is prepared, cooled to 10° C., and 270 parts (2 moles) of sulfur monochloride are added dropwise over a period of 4 hours at about 10°–18° C. The mixture is allowed to stand at room temperature overnight, and after cooling to about 5° C. is filtered. The solid is washed with mineral spirits and air dried. The solid material is the desired product containing 26.3% sulfur (theory, 24.4%).

Example A-1-10

A mixture of 390 parts (3 moles) of ethylacetoacetate and 900 parts of ethyl acetate is prepared and cooled to 10° C. whereupon 202.5 parts (1.5 moles) of sulfur monochloride are added dropwise under nitrogen over a period of 3 hours. The temperature of the reaction reaches about 20° C. during the addition. After standing overnight at room temperature, the mixture is cooled to about 7° C. and filtered. The solids are washed with textile spirits and air dried. The solid material is the desired product containing 9.99% sulfur and having a melting point of 104°–108° C.

Example A-1-11

A mixture of 650 parts (5 moles) of ethylacetoacetate and 730 parts 5 moles) of Alfol 810, a commercial mixture of alcohols containing from 8 to 10 carbon atoms, is prepared and heated to a temperature of 130° C. while collecting distillate. The temperature is slowly increased to 200° C. as ethanol is distilled. The residue is stripped to 10 mm. Hg./120° C., and the residue is the desired product.

A mixture of 1035 parts (4.5 moles) of the ethylacetoacetate/Alfol 810 product and 800 parts of ethyl acetate is prepared and cooled to 10° C. whereupon 304 parts (2.25 moles) of sulfur monochloride are added dropwise under nitrogen for a period of about 3 hours while maintaining the reaction temperature between 10°–15° C. After allowing the mixture to stand overnight at room temperature, the mixture is blown with nitrogen and heated to 110° C. while collecting solvent. After stripping to, 133° C./70 mm. Hg., the mixture is filtered through a filter aid, and the filtrate is the desired product containing 11.75% sulfur (theory, 12.26%).

Example A-1-12

A mixture of 480 parts (3 moles) of diethylmalonate and 800 parts of ethyl acetate is prepared and cooled to 10° C. whereupon 202.5 parts (1.5 moles) of sulfur monochloride are added dropwise under nitrogen at 10°-15° C. over a period of one hour. After allowing the mixture to stand overnight at room temperature, the mixture is heated to reflux to remove most of the solvent. The mixture then is heated to 120° C. while blowing with nitrogen, stripped to a temperature of 30° C./90 mm. Hg., and filtered through a filter aid at room temperature. The filtrate is the desired product containing 15.0% sulfur.

Example A-1-13

A mixture of 480 parts (3 moles) of diethylmalonate, 876 parts (6 moles) of Alfol 810 and 3 parts of para-toluenesulfonic acid is prepared and heated to 140° C. as ethanol is distilled. The temperature is slowly increased to 180° C. while removing additional ethanol. A total of 237 parts of ethanol is collected, and 6 parts of sodium bicarbonate is added to the reaction mixture which is then stripped to 130° C. at 10 mm. Hg. The residue is filtered through a filter aid, and the filtrate is the desired ester.

A mixture of 720 parts (2 moles) of the above-prepared diethylmalonate/Alfol 810 product and 500 parts of ethyl acetate is prepared and cooled to about 7° C. whereupon 135 parts (1 mole) of sulfur monochloride are added dropwise under nitrogen over a period of about 2 hours while maintaining the reaction mixture at 7°-12° C. The solution, is allowed to stand at room temperature overnight, warmed to reflux for 3 hours, and blown with nitrogen while heating to a temperature of about 140° C. to remove solvent. The mixture then is stripped to 140° C. at reduced pressure and filtered at room temperature. The filtrate is the desired product containing 7.51% sulfur.

Example A-1-14

A mixture of 310 parts (4.2 moles) of 1,2-diaminopropane and 1200 parts of water is prepared and cooled to room temperature whereupon 412 parts (2 moles) of a product prepared as in Example A-1-1 are added. The temperature of the mixture reaches 40° C. whereupon solids begin to form. The slurry is maintained at room temperature for about 4 hours and filtered. The solid is washed with water, dried and recovered. The solid is the desired product containing 10.1% nitrogen and 25.7% sulfur. The crude product melts at about 106°-112° C. and the product recrystallized from a methanol/ethanol mixture has a melting point of 114°-116° C.

Example A-1-15

A mixture of 291 parts (1.3 moles) of the hydroxy monoacid prepared as in Example A-1-7, 156 parts (2.6 moles) of normal propanol, 100 parts of toluene and 2 parts of para-toluenesulfonic acid is prepared and heated to the reflux temperature while removing water. After water elimination begins to slow down, an additional one part of the para-toluenesulfonic acid is added, and the refluxing is continued while collecting additional water. Sodium bicarbonate (5 parts) is added and the mixture is stripped at atmospheric pressure to a temperature of 110° C., and thereafter under reduced pressure to 120° C. The residue is filtered at room temperature through a filter aid, and the filtrate is the desired, product containing 24.4% sulfur (theory, 24%).

Example A-1-16

A mixture of 448 parts (2 moles) of the hydroxy monoacid prepared as in Example A-1-7, and 306 parts (3 moles) of acetic anhydride is prepared, heated to about 135° C. and maintained at this temperature for about 6 hours. The mixture is cooled to room temperature, filtered, and the filtrate is stripped to 150° C. at reduced pressure. The residue is filtered while hot, and the filtrate is the desired lactone containing 29.2% sulfur (theory, 31%).

Example A-1-17

A mixture of 412 parts (2 moles) of a dithiabisaldehyde prepared as in Example A-1-1 and 150 parts of toluene is prepared and heated to 80° C. where- upon 382 parts (2 moles) of Primene 81R are added dropwise while blowing with nitrogen at a temperature of 80°-90° C. A water azeotrope is removed during the addition of the Primene 81R, and after the addition is completed, the temperature is raised to 110° C. while removing additional azeotrope. The residue is stripped to 105° C. at reduced pressure and filtered at room temperature through a filter aid. The filtrate is the desired product containing 16.9% sulfur (theory, 16.88%) and 3.64% nitrogen (theory, 3.69%).

Example A-1-18

The general procedure of Example A-1-17 is repeated except that only 206 parts of the thia-bisaldehyde of Example A-1-1 is utilized in the reaction.

Example A-1-19

The general procedure of Example A-1-17 is repeated except that the bisaldehyde of Example A-1-1 is replaced by an equivalent amount of the bisaldehyde of Example A-1-2.

Example A-1-20

The general procedure of Example A-1-17 is repeated except that the bisaldehyde of Example A-1-1 is replaced by an equivalent amount of the bisaldehyde of Example A-1-4.

The sulfur composition useful as reactant (A) in the present invention also may be (A-2) compositions prepared by reacting sulfur and/or sulfur halides with compounds represented by the structural formulae

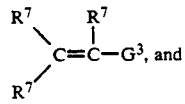

(II)

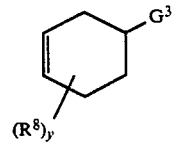

(III)

wherein each of $R^7$ is independently H or a hydrocarbyl group;

$R^8$ is H, a hydrocarbyl group, or a hydrocarbyloxy group;

$G^3$ is C(X)R, C≡N, COOR, $CON(R)_2$, $NO_2$or $R^5C{=}NR^6$ wherein X, R, $R^5$ and $R^6$ are as defined above,; and y is an integer from zero to 5.

The hydrocarbyl groups $R^7$ and $R^8$ may be aliphatic or aromatic groups, and the hydrocarbyl groups may contain up to about 30 carbon atoms. More generally, $R^7$ and $R^8$ are hydrogen or alkyl groups containing up to about 10 carbon atoms. Examples of such alkyl groups include methyl, ethyl, propyl, isopropyl, butyl, hexyl, octyl, etc.

In one embodiment, the compounds represented by Formula II are acrylic derivatives. The compounds may be acrylic acid or derivatives of acrylic acid such as acrylates, alkyl acrylic acids, alkyl acrylates, acrylamides and alkyl acrylamides, acrylonitrile and alkyl-substituted acrylonitrile, acrolein, etc. Specific examples of such compounds include acrolein, crotonaldehyde, methyl vinyl ketone, ethyl vinyl ketone, 4-methyl-3-pentene-2-one, 3-pentene-2-one, acrylonitrile, crotonitrile, acrylic acid, methacrylic acid, methylacrylate, ethylacrylate, butylacrylate, butylmethacrylate, crotonic acid, 2-pentenoic acid, acrylamide, 3,3-dimethylacrylic acid, N,N-dimethylacrylamide, etc.

Compounds of the type represented by Formula III are known and can be prepared by procedures described in the prior art. For example, in reissue patent Re U.S. Pat. No. 27,331, Diels-Alder adducts are described which correspond to Formula III where $G^3$ may be CHO, COOH, $COOCH_3$, $CONH_2$, $COOC_2H_5$, $NO_2$, COOidec, C≡N, $COOC_4H_9$. The disclosure of reissue U.S. Pat. No. 27,331 relating to the preparation of Diels-Alder adducts of the type represented by Formula III is hereby incorporated by reference.

The compositions represented by Formula III may contain from 1 to 5 hydrocarbyl groups $R^8$. The hydrocarbyl groups preferably contain from 1 to 10 carbon atoms. Generally, y in Formula III is 0 or 1.

The compounds represented by Formulae II and III wherein, $G^3$ is $R^5C{=}NR^6$ are prepared from the corresponding aldehydes and ketones by reaction of the aldehydes and ketones with ammonia or primary amines such as described above with respect to the formation of the compounds represented by Formula I where $G^1$ and $G^2$ are $R^5C{=}NR^6$.

The sulfur compounds (A-2) are prepared by reacting sulfur and/or sulfur halides with the compounds represented by structural Formulae II and III. Procedures for sulfurizing these compounds are known to those skilled in the art and are described in the prior art. For example, the sulfurization of olefinic compounds such as represented by Formulae II and III is described in U.S. Pat. No. 4,191,659. The procedure described in the '659 patent utilizes the combination of sulfur and hydrogen sulfide, and the amounts of sulfur and hydrogen sulfide per mole of olefinic compound are, respectively, about 0.3–3.0 gram atoms and about 0.1–1.5 moles. In batch operations, the reactants are introduced at levels to provide these ranges, and in semicontinuous and continuous operations, they may be admixed at any ratio but on a mass balance basis, they are present so as to be consumed in amounts within these ratios. Thus, for example, if the reaction vessel is initially charged with sulfur alone, the olefinic compound and hydrogen sulfide are added incrementally at a rate such that the desired ratio is obtained.

The temperature range at which the sulfurization reaction is carried out is generally about 50°–350° C., and the preferred range is about 100°–200° C. The reaction is conducted under super atmospheric pressure; this may be and usually is autogenous pressure (i.e., the pressure which naturally develops during the course of reaction,, but may also be externally applied pressure.

It is often advantageous to incorporate materials useful as sulfurization catalysts in the reaction mixture. These materials may be acidic, basic or neutral. Useful neutral and acidic materials include acidified clays such as "Super Filtrol", para-toluene sulfonic acid, dialkylphosphorodithioic acids, and phosphorus sulfides such as phosphorus pentasulfide.

The preferred catalysts generally are basic materials, and these may be inorganic oxides and salts such as sodium hydroxide, calcium oxide and sodium sulfide. The most desirable basic catalysts, however, are nitrogen bases including ammonia and amines. The amines include primary, secondary and tertiary hydrocarbyl amines wherein the hydrocarbyl groups are alkyl, aryl, aralkyl, alkaryl, etc. and contain about 1–20 carbon atoms. Suitable amines include aniline, benzylamine, dibenzylamine, dodecylamine, naphthylamine, tallowamines, N-ethyldipropylamine, N-phenylbenzylamine, m-toluidine and 2,3-xylidine. Also useful are heterocyclic amines such as pyrrolidine, piperidine, pyridine and quinoline.

The preferred basic catalysts include ammonia and primary, secondary, or tertiary alkyl amines having about 1 to about 8 carbon atoms in the alkyl groups. Representative examples of this type are methylamine, dimethylamine, trimethylamine, ethylamine, diethylamine, triethylamine, di-n-butylamine and tri-n-octylamine. Mixtures of these amines can be used, as well as mixtures of ammonia and amines. When a catalyst is used, the amount generally is about 0.05 to about 2.0% of the weight of the compound to be sulfurized.

The procedure for sulfurizing the cyclic compounds represented by Formula III is generally similar to the procedure utilized for sulfurizing the compounds represented by Formula II. Generally, a mixture of the substituted unsaturated cycloaliphatic compounds and sulfur is heated to a temperature in the range of about 110° C. to just below the decomposition temperature of the Diels-Alder adducts. Temperatures within the range of about 110° to about 200° C. normally will be used. This reaction results in a mixture of products, some of which have been identified. In the compounds of known structure, the sulfur reacts with the substituted unsaturated cycloaliphatic reactants either at the double bond in the nucleus of the unsaturated reactant or at an allylic hydrogen and forms a divalent sulfur group, containing at least two sulfur atoms, which joins the two nuclear carbons of the same or different cycloaliphatic group.

The ratio of reactants can vary over a wide range, for example, a molar ratio of sulfur to unsaturated cycloaliphatic reactant of from about 0.5:1.0 to about 10:1. As it is normally desirable to incorporate as much stable sulfur into the sulfur-containing compound as possible, a molar excess of sulfur normally is employed. Generally, the molar ratio of sulfur to unsaturated reactant is about 1:1 to about 4:1.

The sulfurization reaction can be conducted in the presence of suitable inert organic solvent such as mineral oils, alkanes of 7 to 18 carbon atoms, etc. although no solvent generally is necessary. After completion of the reaction, the reaction mass can be filtered and/or subjected to other conventional purification techniques. There is no need to separate the various sulfur-containing products as they can be employed in the form of a reaction mixture comprising the compounds of known and unknown structure.

When it is desirable to remove any hydrogen sulfide contaminant in the products, it is advantageous to employ standard procedures such as blowing with steam, alcohols or nitrogen gas. Heating at reduced pressures with or without blowing also is useful in removing hydrogen sulfide.

In another embodiment, the compositions represented by Formulae II and III can be sulfurized with sulfur halides and optionally sulfur in a manner described above with respect to the sulfurization of the compounds represented by Formula I. Such sulfurized products also are useful as reactant (A) in preparing the compositions of the present invention.

The following examples illustrate the preparation of sulfur compositions (A-2).

Example A-2-1

A mixture comprising 400 parts of toluene and 66.7 parts of aluminum chloride is prepared in a reaction vessel. A second mixture comprising 640 parts (5 moles) of butyl acrylate and 240.8 parts of toluene is prepared and added to the aluminum chloride slurry while maintaining the temperature within a range of 37°-58° C. over a period of 0.25 hour. Thereafter, 313 parts (5.8 moles) of butadiene are added to the slurry over a period of 2.75 hours while maintaining the temperature of the reaction mixture at 50°-61° C. by means of external cooling. The mixture is blown with nitrogen for about 20 minutes, transferred to a separatory funnel, and washed with a solution of 150 parts of concentrated hydrochloric acid in 1100 parts of water. The product then is subjected to two additional water washings, and the washed reaction product is distilled to remove unreacted butyl acrylate and toluene. The residue is subjected to a further distillation at 9-10 mm. Hg. mercury and the distillate collected at 105°-115° C. is the desired adduct.

A mixture of 4550 parts (25 moles) of the above butadiene-butyl acrylate adduct and 1600 parts (50 moles) of sulfur flowers is prepared and heated to a temperature of 150°-155° C. for 7 hours while blowing nitrogen through the mixture. The mixture is cooled to room temperature and filtered. The filtrate is the desired sulfur-containing product.

Example A-2-2

The general procedure of Example A-1-1 is repeated except that the butyl acrylate is replaced by an equivalent amount of 2-nitro-1-butene.

Example A-2-3

A mixture of 650 parts (3.55 moles) of the butadiene-butyl acrylate adduct prepared in Example 1, 6.5 parts of triphenylphosphite catalyst and 119.4 parts (3.73 moles) of sulfur powder is prepared and heated slowly to 180° C. in 2.5 hours. The mixture is maintained at about 180°-186° C. for an additional 6.5 hours as hydrogen sulfide is evolved. The mixture then is blown with nitrogen for 6.5 hours at this temperature and filtered through a filter aid. The filtrate is the desired product containing 14.92% sulfur (theory, 15.38%).

Example A-2-4

A mixture of 1023 parts (7.99 moles) of n-butyl acrylate, 237 parts (7.41 moles) of sulfur and 2 parts of triethylamine is prepared and heated to reflux (150° C.). The temperature of the mixture is increased at 210° C. and maintained at this temperature for 4 hours. After stripping the mixture to 200° C. under vacuum, the residue is filtered through a filter aid and the filtrate is the desired product containing 18.9% sulfur (theory, 20.0%).

(B): Phosphite and/or Amine Compounds

The compositions of the present invention are obtained by reacting at least one of the sulfur compositions described above as (A-1) or (A-2) with a di- or trihydrocarbyl phosphite, at least one amine compound containing at least one NH or $NH_2$ group, or a combination of said phosphite and amine, provided, however, when $G^1$ and $G^2$ in (A-1) are —C(X)R, (B) is a di- or trihydrocarbylphosphite or a mixture of said phosphite and an amine compound containing at least one NH or $NH_2$ group. That is, when $G^1$ and $G^2$ are —C(X)R, the aldehyde or ketone (or thio) derivative is not reacted with only an amine.

The di- or trihydrocarbyl phosphites may be represented by the structural formulae

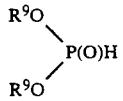
(Va)

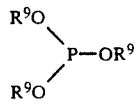
(Vb)

wherein each $R^9$ is independently a hydrocarbyl group. As noted earlier in this application, the terms "hydrocarbyl" or "hydrocarbyl-based" denote a group having a carbon atom directly attached to the oxygen and having predominantly hydrocarbon character within the context of the invention.

The hydrocarbyl groups $R^9$ may be the same or different hydrocarbyl groups, and generally, the total number of carbon atoms in the $R^9$ groups will be at least about 4. In one embodiment the hydrocarbyl groups will contain from 1 to about 30 carbon atoms each, more generally from 1-24, and preferably from about 8 to about 24 carbon atoms each. The hydrocarbyl groups may be aliphatic or aromatic such as alkyl, aryl, alkaryl, aralkyl and alicyclic hydrocarbon groups. Examples of $R^9$ groups include ethyl, n-butyl, n-hexyl, 2-ethylhexyl, 1-nonyl, 1-decyl, 1-dodecyl, 1-tetradecyl, stearyl, 1-hexadecyl, 1-octadecyl, oleyl, linoleyl, linolenyl, phytyl, myricyl, lauryl, cetyl, behenyl, etc. Examples of aromatic hydrocarbyl groups include phenyl, octylphenyl, nonylphenyl, and groups derived from similarly alkylated naphthols. Examples of alicyclic hydrocarbons include cyclohexyl, methylcyclohexyl, etc.

Specific examples of phosphites represented by Formula Va and Vb include dibutyl phosphite, dipentyl phosphite, didecyl phosphite, dipentylphenyl phosphite, tridecyl phosphite, etc.

The $R^9$ groups may each comprise a mixture of hydrocarbyl groups derived from commercial alcohols. Higher synthetic monohydric alcohols of the type formed by Oxo process (e.g., 2-ethylhexyl), the Aldol condensation, or by organo aluminum-catalyzed oligomerization of alpha-olefins (especially ethylene), followed by oxidation and hydrolysis, also are useful. Examples of some preferred monohydric alcohols and alcohol mixtures include the commercially available "Alfol" alcohols marketed by Continental Oil Corporation. Alfol 810 is a mixture containing alcohols consisting essentially of straight chain, primary alcohols having from 8 to 10 carbon atoms. Alfol 12 is a mixture comprising mostly $C_{12}$ fatty alcohols. Alfol 1218 is a mixture of synthetic, primary, straight-chain alcohols having 12 to 18 carbon atoms. The Alfol 20+ alcohols are mixtures of $C_{18}$–$C_{28}$ primary alcohols having mostly, on an alcohol basis, $C_{20}$ alcohols as determined by GLC (gas-liquid-chromatography). The Alfol 22+ alcohols are $C_{18}$–$C_{28}$ primary alcohols having mostly, on an alcohol basis, $C_{22}$ alcohols. These Alfol alcohols can contain a fairly large percentage (up to 40% by weight) of paraffinic compounds which can be removed before the reaction if desired.

Another example of a commercially available alcohol mixture is Adol 60 which comprises about 75% by weight of a straight chain $C_{22}$ primary alcohol, about 15% of a $C_{20}$ primary alcohol and about 8% of $C_{18}$ and $C_{24}$ alcohols. Adol 320 comprises predominantly oleyl alcohol. The Adol alcohols are marketed by Ashland Chemical.

A variety of mixtures of monohydric fatty alcohols derived from naturally occurring triglycerides and ranging in chain length of from $C_8$ to $C_{18}$ are available from Procter & Gamble Company. These mixtures contain various amounts of fatty alcohols containing mainly 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5% of $C_{16}$ alcohol.

Another group of commercially available mixtures include the "Neodol" products available from Shell Chemical Co. For example, Neodol 23 is a mixture of $C_{12}$ and $C_{13}$ alcohols; Neodol 25 is a mixture of $C_{12}$ and $C_{15}$ alcohols; and Neodol 45 is a mixture of $C_{14}$ to $C_{15}$ linear alcohols. Neodol 91 is a mixture of $C_9$, $C_{10}$ and $C_{11}$ alcohols.

Fatty vicinal diols also are useful and these include those available from Ashland Oil under the general trade designation Adol 114 and Adol 158. The former is derived from a straight chain alpha olefin fraction of $C_{11}$–$C_{14}$, and the latter is derived from a $C_{15}$–$C_{18}$ fraction.

The di- and trihydrocarbylphosphites (Va and Vb) which are useful in the preparation of the compositions of the present invention may be prepared by techniques well known in the art, and many phosphites are available commercially. In one method of preparing higher molecular weight phosphites, a lower molecular weight dialkyl phosphite (e.g., dimethyl) is reacted with a higher molecular weight alcohol (e.g., decyl alcohol), and the decyl groups replace the methyl groups (analogous to classic transesterification) with the formation of methanol which is stripped from the reaction mixture.

The following is a specific example of the preparation of a dihydrocarbylphosphite wherein the hydrocarbyl groups contain an average of from about 8 to about 10 carbon atoms.

EXAMPLE P-1

A mixture of 1752 parts (12 moles) of Alfol 8–10 and 660 parts (6 moles) of dimethylphosphite is heated to about 120°–130° C. while sparging with nitrogen. The mixture is held at this temperature for about 8 hours while removing methanol as it is formed. The reaction mixture is vacuum stripped to 140° C. at 30 mm. Hg. The residue is filtered at about room temperature, and the filtrate is the desired product containing 10.3% phosphorus (theory, 9.2).

The amines which are useful as component (B) in the present invention are amines which contain at least one NH or $NH_2$ group, and these amines may be characterized by the formula $$R^{12}R^{13}NH \qquad \text{(VI)}$$

wherein $R^{12}$ and $R^{13}$ are each independently hydrogen, hydrocarbyl, aminohydrocarbyl, or hydroxyhydrocarbyl groups. Generally, the hydrocarbyl, aminohydrocarbyl and hydroxyhydrocarbyl groups will contain up to about 30 carbon atoms and more often will be aliphatic hydrocarbyl groups containing from 1 to about 30 carbon atoms.

In one preferred embodiment, the hydrocarbyl amines which are useful in preparing the imine derivatives of the present invention are primary hydrocarbyl amines (i.e., $R^{13}$ is H) containing from about 2 to about 30 carbon atoms in the hydrocarbyl group, and more preferably from about 4 to about 20 carbon atoms in the hydrocarbyl group. The hydrocarbyl group may be saturated or unsaturated. Representative examples of primary saturated amines are the lower alkyl amines such as methyl amine, ethyl amine, n-propyl amine, n-butyl amine, n-amyl amine, n-hexyl amine; those known as aliphatic primary fatty amines and commercially known as "Armeen" primary amines (products available from Armak Chemicals, Chicago, Illinois). Typical fatty amines include alkyl amines such as n-hexylamine, n-octylamine, n-decylamine, n-dodecylamine, n-tetradecylamine, n-pentadecylamine, n-hexadecylamine, n-octadecylamine (stearyl amine), etc. These Armeen primary amines are available in both distilled and technical grades. While the distilled grade will provide a purer reaction product, the desirable amides, imines and imides will form in reactions with the amines of technical grade. Also suitable are mixed fatty amines such as Armak's Armeen-C, Armeen-O, Armeen-OL, Armeen-T, Armeen-HT, Armeen S and Armeen SD.

In another preferred embodiment, the amine derived products of this invention are those derived from tertiary-aliphatic primary amines having at least about 4 carbon atoms in the alkyl group. For the most part, they are derived from alkyl amines having a total of less than about 30 carbon atoms in the alkyl group.

Usually the tertiary aliphatic primary amines are monoamines represented by the formula

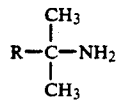

wherein R is a hydrocarbyl group containing from one to about 30 carbon atoms. Such amines are illustrated by tertiary-butyl amine, tertiary-hexyl primary amine, 1-methyl-1-amino-cyclohexane, tertiary-octyl primary amine, tertiary-decyl primary amine, tertiary-dodecyl primary amine, tertiary-tetradecyl primary amine, tertiary-hexadecyl primary amine, tertiary-octadecyl primary amine, tertiary-tetracosanyl primary amine, tertiary-octacosanyl primary amine.

Mixtures of amines are also useful for the purposes of this invention. Illustrative of amine mixtures of this type are "Primene 81R" which is a mixture of $C_{11}$–$C_{14}$- tertiary alkyl primary amines and "Primene JM-T" which is a similar mixture of $C_{18}$–$C_{22}$ tertiary alkyl primary amines (both are available from Rohm and Haas Company). The tertiary alkyl primary amines and methods for their preparation are well known to those of ordinary skill in the art and, therefore, further discussion is unnecessary. The tertiary alkyl primary amine useful for the purposes of this invention and methods for their preparation are described in U.S. Pat. No. 2,945,749 which is hereby incorporated by reference for its teaching in this regard.

Primary amines in which the hydrocarbon chain comprises olefinic unsaturation also are useful. Thus, the $R^6$ group may contain one or more olefinic unsaturation depending on the length of the chain, usually no more than one double bond per 10 carbon atoms. Representative amines are dodecenylamine, myristoleylamine, palmitoleylamine, oleylamine and linoleylamine. Such unsaturated amines also are available under the Armeen tradename.

In another embodiment, the amine of Formula VI is a secondary amine. Secondary amines include dialkylamines having two of the above alkyl groups including such commercial fatty secondary amines as Armeen 2C and Armeen HT, and also mixed dialkylamines where, for example, $R^{12}$ is a fatty amine and $R^{13}$ may be a lower alkyl group (1–9 carbon atoms) such as methyl, ethyl, n-propyl, i-propyl, butyl, etc., or $R^{13}$ may be an alkyl group bearing other non-reactive or polar substituents (CN, alkyl, carbalkoxy, amide, ether, thioether, halo, sulfoxide, sulfone) such that the essentially hydrocarbon character of the group is not destroyed. The fatty polyamine diamines include mono- or dialkyl, symmetrical or asymmetrical ethylene diamines, propane diamines (1,2, or 1,3), and polyamine analogs of the above. Suitable commercial fatty polyamines are "Duomeen C" (N-coco-1,3-diaminopropane), "Duomeen S"(N-soya-1,3-diaminopropane), "Duomeen T" (N-tallow-1,3-diaminopropane), or "Duomeen O " (N-oleyl-1,3-diaminopropane). "Duomeens" are commercially available diamines described in Product Data Bulletin No. 7-10R1 of Armak Chemical Co., Chicago, Illinois. In another embodiment, the secondary amines may be cyclic amines such as piperidine, piperazine, morpholine, etc.

Other primary amines useful as reactant (B) in the preparation of the compositions of the invention are the primary ether amines $R''OR'NH_2$ wherein R' is a divalent alkylene group having 2 to 6 carbon atoms and R'' is a hydrocarbyl group of about 5 to about 150 carbon atoms. These primary ether amines are generally prepared by the reaction of an alcohol R''OH with an unsaturated nitrile. The R'' group of the alcohol can be a hydrocarbon-based group having up to about 150 carbon atoms. Typically, and for efficiency and economy, the alcohol is a linear or branched aliphatic alcohol with R'' having up to about 50 carbon atoms, preferably up to 26 carbon atoms and most preferably R'' has from 6 to 20 carbon atoms. The nitrile reactant can have from 2 to 6 carbon atoms with acrylonitrile being most preferred. Ether amines are known commercial products which are available under the name SURFAM ® produced and marketed by Mars Chemical Company, Atlanta, Georgia. Typical of such amines are those having from about 150 to about 400 molecular weight. Preferred etheramines are exemplified by those identified as SURFAM P14AB (branched $C_{14}$), SURFAM P16A (linear $C_{16}$), SURFAM P17AB (branched $C_{17}$). The carbon chain lengths (i.e., $C_{14}$, etc.) of the SURFAMS described above and used hereinafter are approximate and include the oxygen ether linkage. For example, a $C_{14}$ SURFAM would have the following general formula $$C_{10}H_{21}OC_3H_6NH_2$$

The amines used of Formula V may be hydroxyhydrocarbyl amines. That is, $R^{12}$ and/or $R^{13}$ may be hydroxyhydrocarbyl or hydroxy-hydrocarbyloxyhydrocarbyl groups. In one embodiment, these hydroxyhydrocarbyl amines can be represented by the formula

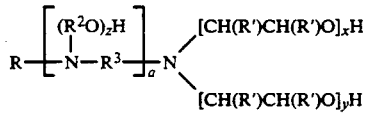

wherein R is a hydrocarbyl group generally containing from about 6 to about 30 carbon atoms, $R^2$ is an ethylene or propylene group, $R^3$ is an alkylene group containing up to about 5 carbon atoms, a is zero or one, each R' is hydrogen or a lower alkyl group, and x, y and z are each independently integers from zero to about 10, at least one of x, y and z being at least 1.

The above hydroxyhydrocarbyl amines can be prepared by techniques well known in the art, and many such hydroxyhydrocarbyl amines are commercially available. They may be prepared, for example, by reaction of primary amines containing at least 6 carbon atoms with various amounts of alkylene oxides such as ethylene oxide, propylene oxide, etc. The primary amines may be single amines or mixtures of amines such as obtained by the hydrolysis of fatty oils such as tallow oils, sperm oils, coconut oils, etc. Specific examples of fatty acid amines containing from about 6 to about 30 carbon atoms include saturated as well as unsaturated aliphatic amines such as octyl amine, decyl amine, lauryl amine, stearyl amine, oleyl amine, myristyl amine, palmityl amine, dodecyl amine, and octadecyl amine.

The useful hydroxyhydrocarbyl amines where a in the above formula is zero include 2-hydroxyethylhexylamine, 2-hydroxyethyloctylamine, 2-hydroxyethyldodecylamine, 2-hydroxyethyltetradecylamine, 2-hydroxyethylpentadecylamine, 2-hydroxyethyleicosylamine, 2-hydroxyethyltriacontylamine, 2-hydroxyethyloleylamine, 2-hydroxyethyltallowamine, 2-hydroxyethylsoyamine, bis-(2-hydroxyethyl)hexylamine, bis(2-hydroxyethyl)octylamine, bis(2-hydroxyethyl)dodecylamine, bis(2-hydroxyethyl)tetradecylamine, bis(2-hydroxyethyl)pentadecylamine, bis(2-hydroxyethyl)eicosylamine, bis(2-hydroxyethyl)-triacontylamine, bis(2-hydroxyethyl)oleylamine, bis(2-hydroxyethyl)tallowamine, bis(2-hydroxyethyl)soyamine, 2-hydroxylpropylhexylamine, 2-hydroxypropyloctylamine, 2-hydroxypropyldodecylamine, 2-hydroxypropyltetradecylamine, 2-hydroxypropylpentadecylamine, 2-hydroxypropyleicosylamine, 2-hydroxypropyltriacontylamine, 2-hydroxypropyloleylamine, 2-hydroxypropyltallowamine, 2-hydroxypropylsoyamine, bis(2-hydroxypropyl)hexylamine, bis(2-hydroxypropyl)octylamine, bis(2-hydroxypropyl)dodecylamine, bis(2-hydroxypropyl)tetradecylamine, bis(2-hydroxypropyl)pentadecylamine, bis(2hydroxypropyl-)eicosylamine, bis(2-hydroxypropyl)triacontylamine, bis(2-hydroxypropyl)oleylamine, bis(2-hydroxy-propyl)tallowamine, bis(2-hydroxypropyl)soyamine and mixtures thereof. Also included are the comparable members wherein in the above formula at least one of x and y is at least 2, as for example, 2-hydroxyethoxyethylhexylamine.

A number of hydroxyhydrocarbyl amines wherein a is zero are available from the Armak Chemical Division of Akzona, Inc., Chicago, Illinois, under the general trade designation "Ethomeen" and "Propomeen". Specific examples of such products include "Ethomeen C/15" which is an ethylene oxide condensate of a coconut fatty amine containing about 5 moles of ethylene oxide; "Ethomeen C/20" and "C/25" which also are ethylene oxide condensation products from coconut fatty amine containing about 10 and 15 moles of ethylene oxide respectively; "Ethomeen O/12" which is an ethylene oxide condensation product of oleyl amine containing about 2 moles of ethylene oxide per mole of amine. "Ethomeen S/15" and "S/20" which are ethylene oxide condensation products with stearyl amine containing about 5 and 10 moles of ethylene oxide per mole of amine respectively; and "Ethomeen T/12, T/15" and "T/25" which are ethylene oxide condensation products of tallow amine containing about 2, 5 and 15 moles of ethylene oxide per mole of amine respectively. "Propomeen O/12" is the condensation product of one mole of oleyl amine with 2 moles propylene oxide.

The phosphorus- and/or nitrogen-containing derivative compositions of sulfur-containing compounds of the present invention are prepared by the process which comprises reacting at least one sulfur compound described above as reactant (A) with (B) a di- or tri-hydrocarbyl phosphite or amine compound as described above, or combinations of said phosphites and amines. Where it is desired to react reactant (A) with a phosphite and an amine, any order of reaction can be utilized. Thus, for example, reactant (A) may be reacted with a phosphite to form an intermediate which is then reacted with an amine, or reactant (A) can be reacted with an amine to form an intermediate which is then reacted with a phosphite. In another embodiment, a mixture of phosphite and amine can be preformed and then reacted with reactant (A).

Although not generally necessary, organic solvents can be included in the reaction mixtures to facilitate handling. The organic solvents preferably should be selected from alcohols, ethers, aliphatic and aromatic hydrocarbons and chlorinated saturated or unsaturated hydrocarbons provided that such solvents are not inert.

The reaction between the sulfur component (A) and the phosphite and/or amine generally is exothermic, and after the exotherm is completed, the reaction mixtures generally are heated to elevated temperatures such as up to about 100° C. at atmospheric pressure to complete the reaction and remove water which is formed in the reaction. After completion of the reaction, vacuum often is applied to remove the final traces of water in solvent (if present). At the end of the reaction, the reaction mixture generally is filtered.

The sulfur compositions (A) may be reacted with varying amounts of the phosphite and/or amine compounds to yield phosphorus and/or nitrogen-containing derivative compositions in accordance with the present invention. Generally, it is desirable to react the sulfur compositions (A) with at least one mole of phosphite or amine per mole of sulfur composition (A). In another embodiment, the reaction mixture contains about one equivalent of amine or phosphite for each equivalent of $G^1$, $G^2$ or $G^3$ present in the sulfur composition (A). For example, with regard to Formula I, when $G^1$ and $G^2$ are C(X)R, one mole of reactant (A) can be reacted with one or two moles of a primary or secondary amine. When the sulfur composition (A) is either of the compounds represented by Formulae II or III, one mole of the compounds represented by Formulae II or III is reacted with one mole of a primary or secondary amine and/or one mole of a phosphite.

In another embodiment, when the sulfur composition is of the type represented by Formula I, one mole of the composition of Formula I can be reacted with one mole of an amine and one mole of a phosphite. Products obtained in this manner generally have a more acceptable odor and are excellent corrosion inhibitors.

The following examples illustrate the preparation of the phosphorus- and/or nitrogen-containing derivative compositions of sulfur-containing compounds of the present invention.

EXAMPLE I

A mixture of 150 parts (1.46 moles) of the bisaldehyde prepared as in Example A-1-1 and 990.3 parts (2.91 moles) of a di-$C_{8-10}$ phosphite prepared as in Example P-1 is prepared and heated to about 80° C. whereupon 5.7 parts of triethylamine are added dropwise over a period of about 15 minutes. The mixture is maintained at about 80° C. for 2 hours, and thereafter maintained at about 100° C. for about 12 hours. The mixture is vacuum stripped at 5 mm. Hg. at 120° C. for 2 hours and filtered. The filtrate is the desired product containing 8.7% phosphorus (theory, 7.8%) and 4.1% sulfur (theory, 4.1%).

EXAMPLE II

A mixture of 250 parts (1.21 moles) of the bisaldehyde prepared as in Example A-1-1 and 826.2 parts (2.43 moles) of a di-$C_{8-10}$ phosphite prepared as in Example P-1 is prepared and heated to about 85° C. whereupon 5.5 parts of triethylamine are added over a period of 15 minutes. The mixture is maintained for 2 hours at 85° C. and for 20 hours at 100° C. After heating to 120° C., the mixture is vacuum stripped at 5 mm. Hg. for 2 hours and filtered. The filtrate is the desired product containing 6.7% phosphorus (theory, 7.0%) and 7.3% sulfur (theory, 7.2%).

EXAMPLE III

A mixture of 401 parts (1.947 moles) of the bisaldehyde prepared as in Example A-1-1 and 661.9 parts (1.947 moles) of a di-$C_{8-10}$ phosphite prepared as in Example P-1 is heated to about 85° C. whereupon 5.5 parts of tributylamine are added dropwise over 15 minutes. The mixture is heated to 85° C. and maintained at this temperature for 2 hours and at 100° C. for 20 hours. After heating to about 120° C., the mixture is vacuum stripped at 10 mm. Hg. for 2 hours. The residue is the desired product containing 5.7% phosphorus (theory, 5.7) and 3.3% sulfur (theory, 11.7%).

EXAMPLE IV

A mixture of 240 parts (1.165 moles) of the bisaldehyde prepared as in Example A-1-1 and 396.1 parts (1.165 moles) of a di-$C_{8-10}$ phosphite prepared as in Example P-1 is prepared and 217.9 parts (1.165 moles) of Primene 81R are added dropwise into the mixture. An exotherm of from 25° C. to 40° C. is observed. The mixture is heated to 70°–75° C. and maintained at this temperature for 3 hours and stripped at 80° C./40 mm. Hg. for 3 hours. The residue is filtered through a filter aid and the filtrate is the desired product containing 4.0% phosphorus (theory, 4.3%) and 1.9% nitrogen (theory, 1.95%).

EXAMPLE V

A mixture of 247.2 parts (1.2 moles) of the bisaldehyde prepared as in Example A-1-1 and 408 parts (1.2 moles) of a di-$C_{8-10}$ phosphite prepared as in Example P-1 is prepared, and 320.4 parts (1.2 moles) of Armeen O are added dropwise over a period of 1.5 hours. An exotherm of from 25° C. to 35° C. is observed and controlled by the rate of addition. When the charge of the amine is completed, the mixture is stirred for 0.5 hour and then heated to 80° C. Water is removed by applying a vacuum of 40 mm. Hg., and heating is continued at 80° C. with vacuum for 3 hours. The residue is filtered through a filter aid at room temperature and the filtrate is the desired product containing 4.0% phosphorus (theory, 3.9%) and 1.77% nitrogen (theory, 1.76%).

EXAMPLE VI

A mixture of 388 parts 2 moles) of di-butyl hydrogen phosphite and 412 parts (2 moles) of the bisaldehyde prepared as in Example A-1-1 is prepared, and 374 parts (2 moles) of Primene 81R are added dropwise over a period of 1.5 hours. An exotherm of from 23° C. to about 45° C. is observed and controlled by the rate of addition of the amine. After all of the amine is added, the mixture is heated to and maintained at a temperature of 75° C. while removing water under vacuum. The residue then is filtered through a filter aid at room temperature, and the filtrate is the desired product containing 5.8% phosphorus (theory, 5.45%), 2.43% nitrogen (theory, 2.46%) and 11.8% sulfur (theory, 11.26%).

EXAMPLE VII

A mixture of 412 parts (2 moles) of a bisaldehyde prepared as in Example A-1-1 and 340 parts (1 mole) of a di-$C_{8-10}$ phosphite prepared as in Example P-1 is prepared, and 561 parts (3 moles) of Primene 81R are added dropwise over a period of 2.5 hours. The temperature of the mixture reaches 65° C. over the period of addition. A vacuum of 30 mm. Hg. is applied, the mixture is heated to 85° C., and water is removed as a distillate over a period of 4 hours. The residue is filtered through a filter aid and the filtrate is the desired product containing 2.4% phosphorus (theory, 2.4%), 3.3% nitrogen (theory, 3.3%) and 10.3% sulfur (theory, 10.1%).

EXAMPLE VIII

A mixture of 152.9 parts (1.39 moles) of dimethyl hydrogen phosphite and 286.3 parts (1.39 moles) of a bisaldehyde prepared as in Example A-1-1 is prepared, and 371.1 parts (1.39 moles) of Armeen O are added dropwise over a period of 2.5 hours. An exotherm of from 25° C. to about 50° C. is observed during the addition of the amine. A vacuum of 30 mm. Hg. is applied, and the mixture is heated to 90° C. under vacuum and maintained at this temperature for about 4 hours while removing water. The residue is cooled and filtered through a filter aid. The filtrate is the desired product containing 5.0% phosphorus (theory, 5.5%), 11.7% sulfur (theory, 11.3) and 2.53% nitrogen (theory, 2.48).

EXAMPLE IX

A mixture of 242.5 parts (1.25 moles) of dibutyl hydrogen phosphite and 257.5 parts (1.25 moles) of a bisaldehyde prepared as in Example A-1-1 is prepared, and 333.8 parts (1.25 moles) of Armeen O are added dropwise over a period of 1.5 hours. An exotherm of from 25° C. to about 40° C. is observed during the addition of the amine. A vacuum of 30 mm. Hg. is applied and the mixture is heated to 100° C. and maintained at this temperature for 20 hours under vacuum while removing water. At this time, an additional 10 parts of Armeen O is added and the mixture is heated to 85° C. and maintained at this temperature for 2 hours while vacuum stripping water. The reaction mixture is cooled and filtered through a filter aid. The filtrate is the desired product containing 2.2% nitrogen (theory, 2.2%) and 10.3% sulfur (theory, 9.7%).

EXAMPLE X

A mixture of 510 parts (1.5 moles) of a di-$C_{8-10}$ phospite prepared as in Example P-1 and 309 parts (1.5 moles) of a bisaldehyde prepared as in Example A-1-1 is prepared, and 109.5 parts (1.5 moles) of n-butyl amine are added dropwise over 1.25 hours. An exotherm of from 25° C. to 45° C. is observed. The mixture is heated to 60° C. and maintained at this temperature for 2 hours whereupon a vacuum of 80 mm. Hg. is applied, and the mixture is maintained at 60° C. for an addition 1.5 hours. The mixture is heated to 70° C. and the vacuum is adjusted to 30–40 mm. Hg. to remove water. The residue is filtered through a filter aid and the filtrate is the desired product containing 10.7% sulfur (theory, 10.6%) and 2.2% nitrogen (theory, 2.3%).

The present invention also contemplates compositions which comprise mixtures of the phosphorus- and/or nitrogen-containing derivative compositions of sulfur-containing compounds described above and (C) at least one carboxylic dispersant characterized by the presence within its molecular structure of (i) at least one polar group selected from acyl, acyloxy or hydrocarbylimidoyl groups, and (ii) at least one group in which a nitrogen or oxygen atom is attached directly to said group (i), and said nitrogen or oxygen atom also is attached to a hydrocarbyl group. The structures of the polar group (i), as defined by the International Union of Pure and Applied Chemistry, are as follows (R representing a hydrocarbon or similar group):

Acyl: $R-\overset{\overset{\displaystyle O}{\|}}{C}-$

Acyloxy: $R-\overset{\overset{\displaystyle O}{\|}}{C}-O-$

Hydrocarbylimidoyl: $R-\overset{\overset{\displaystyle NR}{\|}}{C}-$

Group (ii) is preferably at least one group in which a nitrogen or oxygen atom is attached directly to said polar group, said nitrogen or oxygen atom also being attached to a hydrocarbon group or substituted hydrocarbon group, especially an amino, alkylamino-, polyalkyleneamino-, hydroxy- or alkyleneoxy-substituted hydrocarbon group. With respect to group (ii), the dispersants are conveniently classified as "nitrogen-bridged dispersants" and "oxygen-bridged dispersants" wherein the atom attached directly to polar group (i) is nitrogen or oxygen, respectively.

Generally, the carboxylic dispersants can be prepared by the reaction of a hydrocarbon-substituted succinic acid-producing compound (herein sometimes referred to as the "succinic acylating agent") with at least about one-half equivalent, per equivalent of acid-producing compound, of an organic hydroxy compound, or an amine containing at least one hydrogen attached to a nitrogen group, or a mixture of said hydroxy compound and amine. The carboxylic dispersants (C) obtained in this manner are usually complex mixtures whose precise composition is not readily identifiable. The nitrogen-containing carboxylic dispersants are sometimes referred to herein as "acylated amines". The compositions obtained by reaction of the acylating agent and alcohols are sometimes referred to herein as "carboxylic ester" dispersants. The carboxylic dispersants (C) are either oil-soluble, or they are soluble in the oil-containing lubricating and functional fluids of this invention.

The soluble nitrogen-containing carboxylic dispersants useful as component (C) in the compositions of the present invention are known in the art and have been described in many U.S. patents including

| | | |
|---|---|---|
| 3,172,892 | 3,341,542 | 3,630,904 |
| 3,219,666 | 3,444,170 | 3,787,374 |
| 3,272,746 | 3,454,607 | 4,234,435 |
| 3,316,177 | 3,541,012 | |

The carboxylic ester dispersants useful as (C) also have been described in the prior art. Examples of patents describing such dispersants include U.S. Pat. Nos. 3,381,022; 3,522,179; 3,542,678; 3,957,855; and 4,034,038. Carboxylic dispersants prepared by reaction of acylating agents with alcohols and amines or amino alcohols are described in, for example, U.S. Pat. Nos. 3,576,743 and 3,632,511.

The above U.S. patents are expressly incorporated herein by reference for their teaching of the preparation of carboxylic dispersants useful as component (C).

In general, a convenient route for the preparation of the nitrogen-containing carboxylic dispersants (C) comprises the reaction of a hydrocarbon-substituted succinic acid-producing compound ("carboxylic acid acylating agent") with an amine containing at least one hydrogen attached to a nitrogen atom (i.e., H−N<). The hydrocarbon-substituted succinic acid-producing compounds include the succinic acids, anhydrides, halides and esters. The number of carbon atoms in the hydrocarbon substituent on the succinic acid-producing compound may vary over a wide range provided that the nitrogen-containing composition (C) is soluble in the lubricating compositions of the present invention. Thus, the hydrocarbon substituent generally will contain an average of at least about 30 aliphatic carbon atoms and preferably will contain an average of at least about 50 aliphatic carbon atoms. In addition to the oil-solubility considerations, the lower limit on the average number of carbon atoms in the substituent also is based upon the effectiveness of such compounds in the lubricating oil compositions of the present invention. The hydrocarbyl substituent of the succinic compound may contain polar groups as indicated above, and, providing that the polar groups are not present in proportion sufficiently large to significantly alter the hydrocarbon character of the substituent.

The sources of the substantially hydrocarbon substituent include principally the high molecular weight substantially saturated petroleum fractions and substantially saturated olefin polymers, particularly polymers of mono-olefins having from 2 to 30 carbon atoms. The especially useful polymers are the polymers of 1-mono-olefins such as ethylene, propene, 1-butene, isobutene, 1-hexene, 1-octene, 2-methyl-1-heptene, 3-cyclohexyl-1-butene, and 2-methyl-5-propyl-1-hexene. Polymers of medial olefins, i.e., olefins in which the olefinic linkage is not at the terminal position, likewise are useful. They are illustrated by 2-butene, 2-pentene, and 4-octene.

Also useful are the interpolymers of the olefins such as those illustrated above with other interpolymerizable olefinic substances such as aromatic olefins, cyclic, olefins, and polyolefins. Such interpolymers include, for example, those prepared by polymerizing isobutene with styrene; isobutene with butadiene; propene with isoprene; ethylene with piperylene; isobutene with chloroprene; isobutene with p-methyl styrene; 1-hexene with 1,3-hexadiene; 1-octene with 1-hexene; 1-heptene with 1-pentene; 3-methyl-1-butene with 1-octene; 3,3-dimethyl-1-pentene with 1-hexene; isobutene with styrene and piperylene; etc.

The relative proportions of the mono-olefins to the other monomers in the interpolymers influence the stability and oil-solubility of the final products derived from such interpolymers. Thus, for reasons of oil-solubility and stability the interpolymers contemplated for use in this invention should be substantially aliphatic and substantially saturated, i.e., they should contain at least about 80%, preferably at least about 95%, on a weight basis of units derived from the aliphatic mono-olefins and no more than about 5% of olefinic linkages based on the total number of carbon-to-carbon covalent linkages. In most instances, the percentage of olefinic linkages should be less than about 2% of the total number of carbon-to-carbon covalent linkages.

Specific examples of such interpolymers include copolymer of 95% (by weight) of isobutene with 5% of styrene; terpolymer of 98% of isobutene with 1% of piperylene and 1% of chloroprene; terpolymer of 95% of isobutene with 2% of 1-butene and 3% of 1-hexene, terpolymer of 80% of isobutene with 20% of 1-pentene and 20% of 1-octene; copolymer of 80% of 1-hexene and 20% of 1-heptene; terpolymer of 90% of isobutene with 2% of cyclohexene and 8% of propene; and copolymer of 80% of ethylene and 20% of propene.

Another source of the substantially hydrocarbon group comprises saturated aliphatic hydrocarbons such as highly refined high molecular weight white oils or synthetic alkanes such as are obtained by hydrogenation of high molecular weight olefin polymers illustrated above or high molecular weight olefinic substances.

The use of olefin polymers having molecular weights (Mn) of about 700–10,000 is preferred. Higher molecular weight olefin polymers having molecular weights (Mn) from about 10,000 to about 100,000 or higher have been found to impart also viscosity index improving properties to the final products of this invention. The use of such higher molecular weight olefin polymers often is desirable. Preferably the substituent is derived from a polyolefin characterized by an Mn value of about 700 to about 10,000, and an Mw/Mn value of 1.0 to about 4.0.

In preparing the substituted succinic acylating agents of this invention, one or more of the above-described polyalkenes is reacted with one or more acidic reactants selected from the group consisting of maleic or fumaric reactants such as acids or anhydrides. Ordinarily the maleic or fumaric reactants will be maleic acid, fumaric acid, maleic anhydride, or a mixture of two or more of these. The maleic reactants are usually preferred over the fumaric reactants because the former are more readily available and are, in general, more readily reacted with the polyalkenes (or derivatives thereof) to prepare the substituted succinic acid-producing compounds useful in the present invention. The especially preferred reactants are maleic acid, maleic anhydride, and mixtures of these. Due to availability and ease of reaction, maleic anhydride will usually be employed.

For convenience and brevity, the term "maleic reactant" is often used hereinafter. When used, it should be understood that the term is generic to acidic reactants selected from maleic and fumaric reactants including a mixture of such reactants. Also, the term "succinic acylating agents" is used herein to represent the substituted succinic acid-producing compounds.

One procedure for preparing the substituted succinic acylating agents useful in this invention is illustrated, in part, in U.S. Pat. No. 3,219,666 which is expressly incorporated herein by reference for its teachings in regard to preparing succinic acylating agents. This procedure is conveniently designated as the "two-step procedure". It involves first chlorinating the polyalkene until there is an average of at least about one chloro group for each molecular weight of polyalkene. (For purposes of this invention, the molecular weight of the polyalkene is the weight corresponding to the Mn value.) Chlorination involves merely contacting the polyalkene with chlorine gas until the desired amount of chlorine is incorporated into the chlorinated polyalkene. Chlorination is generally carried out at a temperature of about 75° C. to about 125° C. If a diluent is used in the chlorination procedure, it should be one which is not itself readily subject to further chlorination. Poly- and perchlorinated and/or fluorinated alkanes and benzenes are examples of suitable diluents.

The second step in the two-step chlorination procedure, for purposes of this invention, is to react the chlorinated polyalkene with the maleic reactant at a temperature usually within the range of about 100° C. to about 200° C. The mole ratio of chlorinated polyalkene to maleic reactant is usually about 1:1. (For purposes of this invention, a mole of chlorinated polyalkene is that weight of chlorinated polyalkene corresponding to the Mn value of the unchlorinated polyalkene.) However, a stoichiometric excess of maleic reactant can be used, for example, a mole ratio of 1:2. If an average of more than about one chloro group per molecule of polyalkene is introduced during the chlorination step, then more than one mole of maleic reactant can react per molecule of chlorinated polyalkene. Because of such situations, it is better to describe the ratio of chlorinated polyalkene to maleic reactant in terms of equivalents. (An equivalent weight of chlorinated polyalkene, for purposes of this invention, is the weight corresponding to the Mn value divided by the average number of chloro groups per molecule of chlorinated polyalkene while the equivalent weight of a maleic reactant is its molecular weight.) Thus, the ratio of chlorinated polyalkene to maleic reactant will normally be such as to provide about one equivalent of maleic reactant for each mole of chlorinated polyalkene up to about one equivalent of maleic reactant for each equivalent of chlorinated polyalkene with the understanding that it is normally desirable to provide an excess of maleic reactant; for example, an excess of about 5% to about 25% by weight. Unreacted excess maleic reactant may be stripped from the reaction product, usually under vacuum, or reacted during a further stage of the process as explained below.

The resulting polyalkene-substituted succinic acylating agent is, optionally, again chlorinated if the desired number of succinic groups are not present in the product. ,If there is present, at the time of this subsequent chlorination, any excess maleic reactant from the second step, the excess will react as additional chlorine is introduced during the subsequent chlorination. Otherwise, additional maleic reactant is introduced during and/or subsequent to the additional chlorination step. This technique can be repeated until the total number of succinic groups per equivalent weight of substituent groups reaches the desired level.

Another procedure for preparing substituted succinic acid acylating agents useful in this invention utilizes a process described in U.S. Pat. No. 3,912,764 and U.K. Patent 1,440,219, both of which are expressly incorporated herein by reference for their teachings in regard to that process. According to that process, the polyalkene and the maleic reactant are first reacted by heating them together in a "direct alkylation" procedure. When the direct alkylation step is completed, chlorine is introduced into the reaction mixture to promote reaction of the remaining unreacted maleic reactants. According to the patents, 0.3 to 2 or more moles of maleic anhydride are used in the reaction for each mole of olefin polymer; i.e., polyalkylene. The direct alkylation step is conducted at temperatures of 180°-250° C. During the chlorine-introducing stage, a temperature of 160°-225° C. is employed. In utilizing this process to prepare the substituted succinic acylating agents of this invention, it would be necessary to use sufficient maleic reactant and chlorine to incorporate at least 1.3 succinic groups into the final product for each equivalent weight of polyalkene.

Another process for preparing the substituted succinic acylating agents of this invention is the so-called "one-step" process. This process is described in U.S. Pat. Nos. 3,215,707 and 3,231,587. Both are expressly incorporated herein by reference for their teachings in regard to that process.

Basically, the one-step process involves preparing a mixture of the polyalkene and the maleic reactant containing the necessary amounts of both to provide the desired substituted succinic acylating agents of this invention. This means that there must be at least one mole of maleic reactant for each mole of polyalkene in order that there can be at least one succinic group for each equivalent weight of substituent groups. Chlorine is then introduced into the mixture, usually by passing chlorine gas through the mixture with agitation, while maintaining a temperature of at least about 140° C.

A variation of this process involves adding additional maleic reactant during or subsequent to the chlorine introduction but, for reasons explained in U.S. Pat. Nos. 3,215,707 and 3,231,587, this variation is presently not as preferred as the situation where all the polyalkene and all the maleic reactant are first mixed before the introduction of chlorine.

Usually, where the polyalkene is sufficiently fluid at 140° C. and above, there is no need to utilize an additional substantially inert, normally liquid solvent/diluent in the one-step process. However, as explained hereinbefore, if a solvent/diluent is employed, it is preferably one that resists chlorination. Again, the poly- and perchlorinated and/or -fluorinated alkanes, cycloalkanes, and benzenes can be used for this purpose.

Chlorine may be introduced continuously or intermittently during the one-step process. The rate of introduction of the chlorine is not critical although, for maximum utilization of the chlorine, the rate should be about the same as the rate of consumption of chlorine in the course of the reaction. When the introduction rate of chlorine exceeds the rate of consumption, chlorine is evolved from the reaction mixture. It is often advantageous to use a closed system, including superatmospheric pressure, in order to prevent loss of chlorine so as to maximize chlorine utilization.

The minimum temperature at which the reaction in the one-step process takes place at a reasonable rate is about 140° C. Thus, the minimum temperature at which the process is normally carried out is in the neighborhood of 140° C. The preferred temperature range is usually between about 160°-220° C. Higher temperatures such as 250° C. or even higher may be used but usually with little advantage. In fact, temperatures in excess of 220° C. are often disadvantageous with respect to preparing the particular acylated succinic compositions of this invention because they tend to "crack" the polyalkenes (that is, reduce their molecular weight by thermal degradation) and/or decompose the maleic reactant. For this reason, maximum temperatures of about 200°-210° C. are normally not exceeded. The upper limit of the useful temperature in the one-step process is determined primarily by the decomposition point of the components in the reaction mixture including the reactants and the desired products. The decomposition point is that temperature at which there is sufficient decomposition of any reactant or product such as to interfere with the production of the desired products.

In the one step process, the molar ratio of maleic reactant to chlorine is such that there is at least about one mole of chlorine for each mole of maleic reactant to be incorporated into the product. Moreover, for practical reasons, a slight excess, usually in the neighborhood of about 5% to about 30% by weight of chlorine, is utilized in order to offset any loss of chlorine from the reaction mixture. Larger amounts of excess chlorine may be used but do not appear to produce any beneficial results.

The molar ratio of polyalkene to maleic reactant preferably is such that there is at least about one mole of maleic reactant for each mole of polyalkene. This is necessary in order that there can be at least 1.0 succinic group per equivalent weight of substituent group in the product. Preferably, however, an excess of maleic reactant is used. Thus, ordinarily about a 5% to about 25% excess of maleic reactant will be used relative to that amount necessary to provide the desired number of succinic groups in the product.

The amines which are reacted with the succinic acid-producing compounds to form the nitrogen-containing compositions (C) may be monoamines and polyamines. The monoamines and polyamines must be characterized by the presence within their structure of at least one H—N group. Therefore, they have at least one primary (i.e., $H_2N$—) or secondary amino (i.e.,1 H—N=) group. The amines can be aliphatic, cycloaliphatic, aromatic, or heterocyclic, including aliphatic-substituted cycloaliphatic, aliphatic-substituted aromatic, aliphatic-substituted heterocyclic, cycloaliphatic-substituted aliphatic, cycloaliphatic-substituted aromatic, cycloaliphatic-substituted heterocyclic, aromatic-substituted aliphatic, aromatic-substituted cycloaliphatic, aromatic-substituted heterocyclic-substituted alicyclic, and heterocyclic-substituted aromatic amines and may be saturated or unsaturated. The amines may also contain non-hydrocarbon substituents or groups as long as these groups do not significantly interfere with the reaction of the amines with the acylating reagents of this invention. Such non-hydrocarbon substituents or groups include lower alkoxy, lower alkyl mercapto, nitro, interrupting groups such as —O— and —S— (e.g., as in such groups as —$CH_2CH_2$—X—$CH_2CH_2$— where X is —O— or —S—). In general, the amine of (C) may be characterized by the formula $$R_AR_BNH$$

wherein $R_A$ and $R_B$ are each independently hydrogen or hydrocarbon, amino-substituted hydrocarbon, hydroxy-substituted hydrocarbon, alkoxy-substituted hydrocarbon, amino, carbamyl, thiocarbamyl, guanyl and acylimidoyl groups provided that only one of $R_A$ and $R_B$ may be hydrogen.

With the exception of the branched polyalkylene polyamine, the polyoxyalkylene polyamines, and the high molecular weight hydrocarbyl-substituted amines described more fully hereafter, the amines ordinarily contain less than about 40 carbon atoms in total and usually not more than about 20 carbon atoms in total.

Aliphatic monoamines include mono-aliphatic and di-aliphatic substituted amines wherein the aliphatic groups can be saturated or unsaturated and straight or branched chain. Thus, they are primary or secondary aliphatic amines. Such amines include, for example, mono- and di-alkyl-substituted amines, mono- and dialkenyl-substituted amines, and amines having one N-alkenyl substituent and one N-alkyl substituent and the like. The total number of carbon atoms in these aliphatic monoamines will, as mentioned before, normally not exceed about 40 and usually not exceed about 20 carbon atoms. Specific examples of such monoamines include ethylamine, diethylamine, n-butylamine, di-n-butylamine, allylamine, isobutylamine, cocoamine, stearylamine, laurylamine, methyllaurylamine, oleylamine, N-methyl-octylamine, dodecylamine, octadecylamine, and the like. Examples of cycloaliphatic-substituted aliphatic amines, aromatic-substituted aliphatic amines, and heterocyclic-substituted aliphatic amines, include 2-(cyclohexyl)-ethylamine, benzylamine, phenethylamine, and 3-(furylpropyl)amine.

Cycloaliphatic monoamines are those monoamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentenylamines, N-ethyl-cyclohexylamine, dicyclohexylamines, and the like. Examples of aliphatic-substituted, aromatic-substituted, and heterocyclic-substituted cycloaliphatic monoamines include propyl-substituted cyclohexylamines, phenyl-substituted cyclopentylamines, and pyranyl-substituted cyclohexylamine.

Aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthalene. Examples of aromatic monoamines include aniline, di(-para-methylphenyl)amine, naphthylamine, N-(n-butyl-)aniline, and the like. Examples of aliphatic-substituted, cycloaliphatic-substituted, and heterocyclic-substituted aromatic monoamines are para-ethoxyaniline, para-dodecylaniline, cyclohexyl-substituted naphthylamine, and thienyl-substituted aniline.

The polyamines from which (C) is derived include principally alkylene amines conforming for the most part to the formula

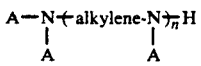

wherein n is an integer preferably less than about 10, A is a hydrogen group or a substantially hydrocarbon group preferably having up to about 30 carbon atoms, and the alkylene group is preferably a lower alkylene group having less than about 8 carbon atoms. The alkylene amines include principally methylene amines, ethylene amines, butylene amines, propylene amines, pentylene amines, hexylene amines, heptylene amines, octylene amines, other polymethylene amines. They are exemplified specifically by: ethylene diamine, triethylene tetramine, propylene diamine, decamethylene diamine, octamethylene diamine, di(heptamethylene) triamine, tripropylene tetramine, tetraethylene pentamine, trimethylene diamine, pentaethylene hexamine, di(-trimethylene) triamine. Higher homologues such as are obtained by condensing two or more of the above-illustrated alkylene amines likewise are useful.

The ethylene amines are especially useful. They are described in some detail under the heading "Ethylene Amines" in Encyclopedia of Chemical Technology, Kirk and Othmer, Vol. 5, pp. 898–905, Interscience Publishers, New York (1950). Such compounds are prepared most conveniently by the reaction of an alkylene chloride with ammonia. The reaction results in the production of somewhat complex mixtures of alkylene amines, including cyclic condensation products such as piperazines. These mixtures find use in the process of this invention. On the other hand, quite satisfactory products may be obtained also by the use of pure alkylene amines. An especially useful alkylene amine for reasons of economy as well as effectiveness of the products derived therefrom is a mixture of ethylene amines prepared by the reaction of ethylene chloride and ammonia and having a composition which corresponds to that of tetraethylene pentamine.

Hydroxyalkyl-substituted alkylene amines, i.e., alkylene amines having one or more hydroxyalkyl substituents on the nitrogen atoms, likewise are contemplated for use herein. The hydroxyalkyl-substituted alkylene amines are preferably those in which the alkyl group is a lower alkyl group, i.e., having less than about 6 carbon atoms. Examples of such amines include N-(2-hydroxyethyl)ethylene diamine, N,N'-bis(2-hydroxyethyl-)ethylene diamine, 1-(2-hydroxyethyl)piperazine, monohydroxypropyl-substituted diethylene triamine, 1,4-bis(2-hydroxypropyl)piperazine, di-hydroxypropyl-substituted tetraethylene pentamine, N-(3-hydroxypropyl)tetramethylene diamine, and 2-heptadecyl-1-(2-hydroxyethyl)imidazoline.

Higher homologues such as are obtained by condensation of the above illustrated alkylene amines or hydroxy alkyl-substituted alkylene amines through amino radicals or through hydroxy radicals are likewise useful. It will be appreciated that condensation through amino, radicals results in a higher amine accompanied with removal of ammonia and that condensation through the hydroxy radicals results in products containing ether linkages accompanied with removal of water.

Heterocyclic mono- and polyamines can also be used in making the nitrogen-containing compositions (C). As used herein, the terminology "heterocyclic mono- and polyamine(s)" is intended to describe those heterocyclic amines containing at least one primary or secondary amino group and at least one nitrogen as a heteroatom in the heterocyclic ring. However, as long as there is present in the heterocyclic mono- and polyamines at least one primary or secondary amino group, the hetero-N atom in the ring can be a tertiary amino nitrogen; that is, one that does not have hydrogen attached directly to the ring nitrogen. Heterocyclic amines can be saturated or unsaturated and can contain various substituents such as nitro, alkoxy, alkyl mercapto, alkyl, alkenyl, aryl, alkaryl, or aralkyl substituents. Generally, the total number of carbon atoms in the substituents will not exceed about 20. Heterocyclic amines can contain hetero atoms other than nitrogen, especially oxygen and sulfur. Obviously they can contain more than one nitrogen hetero atom. The 5- and 6-membered heterocyclic rings are preferred.

Among the suitable heterocyclics are aziridines, azetidines, azolidines, tetra- and di-hydro pyridines, pyrroles, indoles, piperidines, imidazoles, di- and tetrahydroimidazoles, piperazines, isoindoles, purines, morpholines, thiomorpholines, N-aminoalkylmorpholines, N-aminoalkylthiomorpholines, N-aminoalkylpiperazines, N,N'-di-aminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl-substituted piperidines, piperazine, aminoalkyl-substituted piperazines, morpholine, aminoalkyl-substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine.

The nitrogen-containing composition (C) obtained by reaction of the succinic acid-producing compounds and the amines described above may be amine salts, amides, imides, imidazolines as well as mixtures thereof. To prepare the nitrogen-containing composition (C), one or more of the succinic acid-producing compounds and one or more of the amines are heated, optionally in the presence of a normally liquid, substantially inert organic liquid solvent/diluent at an elevated temperature generally in the range of from about 80° C. up to the decomposition point of the mixture or the product. Normally, temperatures in the range of about 100° C. up to about 300° C. are utilized provided that 300° C. does not exceed the decomposition point.

The succinic acid-producing compound and the amine are reacted in amounts sufficient to provide at least about, one-half equivalent, per equivalent of acid-producing compound, of the amine. Generally, the maximum amount of amine present will be about 2 moles of amine per equivalent of succinic acid-producing compound. For the purposes of this invention, an equivalent of the amine is that amount of the amine corresponding to the total weight of amine divided by the total number of nitrogen atoms present. Thus, octyl amine has an equivalent weight equal to its molecular weight; ethylene diamine has an equivalent weight equal to one-half its molecular weight; and aminoethyl piperazine has an equivalent weight equal to one-third its molecular weight. The number of equivalents of succinic acid-producing compound depends on the number of carboxylic functions present in the hydrocarbon-substituted succinic acid-producing compound. Thus, the number of equivalents of hydrocarbon-substituted succinic acid-producing compound will vary with the number of succinic groups present therein, and generally, there are two equivalents of acylating reagent for each succinic group in the acylating reagents. Conventional techniques may be used to determine the number of carboxyl functions (e.g., acid number, saponification number) and, thus, the number of equivalents of acylating reagent available to react with amine. Additional details and examples of the procedures for preparing the nitrogen-containing compositions of the present invention by reaction of succinic acid-producing compounds and amines are included in, for example, U.S. Pat. Nos. 3,172,892; 3,219,666; 3,272,746; and 4,234,435, the disclosures of which are hereby incorporated by reference.

Oxygen-bridged dispersants comprise the esters of the above-described carboxylic acids, as described (for example) in the aforementioned U.S. Pat. Nos. 3,381,022 and 3,542,678. As such, they contain acyl or occasionally, acylimidoyl groups. (An oxygen-bridged dispersant containing an acyloxy group as the polar group would be a peroxide, which is unlikely to be stable under all conditions of use of the compositions of this invention.) These esters are preferably prepared by conventional methods, usually the reaction (frequently in the presence of an acidic catalyst) of the carboxylic acid-producing compound with an organic hydroxy compound which may be aliphatic compound such as a monohydric or polyhydric alcohol or with an aromatic compound such as a phenol or naphthol. The preferred hydroxy compounds are alcohols containing up to about 40 aliphatic carbon atoms. These may be monohydric alcohols such as methanol, ethanol, isooctanol, dodecanol, cyclohexanol, neopentyl alcohol, monomethyl ester of ethylene glycol and the like, or polyhydric alcohols including ethylene glycol, diethylene glycol, dipropylene glycol, tetramethylene glycol, pentaerythritol, glycerol and the like. Carbohydrates (e.g., sugars, starches, cellulose) are also suitable as are partially esterified derivatives of polyhydric alcohols having at least three hydroxy groups.

The reaction is usually effected at a temperature above about 100° C. and typically at 150°-300° C. The esters may be neutral or acidic, or may contain unesterified hydroxy groups, according as the ratio or equivalents of acid-producing compound to hydroxy compound is equal to, greater than or less than 1:1.

As will be apparent, the oxygen-bridged dispersants are normally substantially neutral or acidic. They are among the preferred ester dispersants for the purposes of this invention.

It is possible to prepare mixed oxygen- and nitrogen-bridged dispersants by reacting the acylating agent simultaneously or, preferably, sequentially with nitrogen-containing and hydroxy reagents such as those previously described. The relative amounts of the nitrogen-containing and hydroxy reagents may be between about 10:1 and 1:10, on an equivalent weight basis. The methods of preparation of the mixed oxygen- and nitrogen-bridged dispersants are generally the same as for the individual dispersants described, except that two sources of group (ii) are used. As previously noted, substantially neutral or acidic dispersants are preferred, and a typical method of producing mixed oxygen- and nitrogen-bridged dispersants of this type (which are especially preferred) is to react the acylating agent with the hydroxy reagent first and subsequently react the intermediate thus obtained with a suitable nitrogen-containing reagent in an amount to afford a substantially neutral or acidic product.

The carboxylic dispersants (C) useful in the lubricating compositions of the present invention may also contain boron. The boron-containing compositions are prepared by the reaction of (C-1) at least one boron compound selected from the class consisting of boron trioxides, boron halides, boron acids, boron amides and esters of boron acids with (C-2) at least one soluble carboxylic dispersant intermediate prepared by the reaction of a hydrocarbon substituted succinic acid-producing compound (acylating agent) with at least about one-half equivalent, per equivalent of acid-producing compound, of an organic hydroxy compound or an amine containing at least one hydrogen attached to a nitrogen atom, or a mixture of said hydroxy compound and amine.

The carboxylic dispersant intermediate (C-2) described above is identical to the oil-soluble carboxylic dispersants (C) described above which have not been reacted with a boron compound. The amount of boron compound reacted with intermediate (C-2) generally is sufficient to provide from about 0.1 atomic proportion of boron for each mole of the dispersant up to about 10 atomic proportions of boron for each atomic proportion of nitrogen of said dispersant (C-2). More generally the amount of boron compound present is sufficient to provide from about 0.5 atomic proportion of boron for each mole of the dispersant (C-2) to about 2 atomic proportions of boron for each atomic proportion of nitrogen in the dispersant. When the carboxylic dispersant is an ester type dispersant, the amount of boron used may vary over a wide range. Generally at least about 0.5 mole of the succinic reactant and at least about one mole of the boron reactant are used for each mole of organic hydroxy reactant. Also, the total amount of the succinic reactant and the boron reactant usually range from about 2 moles to as many moles as the number of hydroxy groups present in the organic hydroxy compound. The preferred amounts of the three reactants involved are such that one mole of the hydroxy compound is used with at least about one mole of the succinic reactant and at least about one mole of the boron reactant. Further, the molar ratio of the succinic reactant to the boron reactant is within the range of about 5:1 to 1:5.

The boron compounds useful in the present invention include boron oxide, boron oxide hydrate, boron trioxide, boron trifluoride, boron tribromide, boron trichloride, boron acids such as boronic acid (i.e., alkyl-$B(OH)_2$ or aryl-$B(OH)_2$), boric acid (i.e., $H_3BO_3$), tetraboric acid (i.e., $H_2B_4O_7$), metaboric acid (i.e., $HBO_2$), boron anhydrides, boron amides and various esters of such boron acids. The use of complexes of boron trihalide with ethers, organic acids, inorganic acids, or hydrocarbons is a convenient means of introducing the boron reactant into the reaction mixture. Such complexes are known and are exemplified by boron-trifluoride-triethyl ester, boron trifluoride-phosphoric acid, boron trichloride-chloroacetic acid, boron tribromide-dioxane, and boron trifluoride-methyl ethyl ether.

Specific examples of boronic acids include methyl boronic acid, phenyl-boronic acid, cyclohexyl boronic acid, p-heptylphenyl boronic acid and dodecyl boronic acid.

The boron acid esters include especially mono-, di-, and tri-organic esters of boric acid with alcohols or phenols such as, e.g., methanol, ethanol, isopropanol, cyclohexanol, cyclopentanol, 1-octanol, 2-octanol, dodecanol, behenyl alcohol, oleyl alcohol, stearyl alcohol, benzyl alcohol, 2-butyl cyclohexanol, ethylene glycol, propylene glycol, trimethylene glycol, 1,3-butanediol, 2,4-hexanediol, 1,2-cyclohexanediol, 1,3-octanediol, glycerol, pentaerythritol diethylene glycol, carbitol, Cellosolve, triethylene glycol, tripropylene glycol, phenol, naphthol, p-butylphenol, o,p-diheptylphenol, n-cyclohexylphenol, 2,2-bis-(p-hydroxyphenyl)propane, polyisobutene (molecular weight of 1500)-substituted phenol, ethylene chlorohydrin, o-chlorophenol, m-nitrophenol, 6-bromo-octanol, and 7-keto-decanol. Lower alcohols, 1,2-glycols, and 1-3-glycols, i.e., those having less than about 8 carbon atoms are especially useful for preparing the boric acid esters for the purpose of this invention.

Methods for preparing the esters of boron acid are known and disclosed in the art (such as "Chemical Reviews," pp. 959-1064, Vol. 56). Thus, one method involves the reaction of boron trichloride with 3 moles of an alcohol or a phenol to result in a tri-organic borate. Another method involves the reaction of boric oxide with an alcohol or a phenol. Another method involves the direct esterification of tetra boric acid with 3 moles of an alcohol or a phenol. Still another method involves the direct esterification of boric acid with a glycol to form, e.g., a cyclic alkylene borate.

The reaction of the dispersant intermediate (C-2) with the boron compounds can be effected simply by mixing the reactants at the desired temperature. The use of an inert solvent is optional although it is often desirable, especially when a highly viscous or solid reactant is present in the reaction mixture. The inert solvent may be a hydrocarbon such as benzene, toluene, naphtha, cyclohexane, n-hexane, or mineral oil. The temperature of the reaction may be varied within wide ranges. Ordinarily it is preferably between about 50° C. and about 250° C. In some instances it may be 25° C. or even lower. The upper limit of the temperature is the decomposition point of the particular reaction mixture and/or product.

The reaction is usually complete within a short period such, as 0.5 to 6 hours. After the reaction is complete, the product may be dissolved in the solvent and the resulting solution purified by centrifugation or filtration if it appears to be hazy or contain insoluble substances. Ordinarily the product is sufficiently pure so that further purification is unnecessary or optional.

The reaction of the acylated nitrogen compositions with the boron compounds results in a product containing boron and substantially all of the nitrogen originally present in the nitrogen reactant. It is believed that the reaction results in the formation of a complex between boron and nitrogen. Such complex may involve in some instances more than one atomic proportion of boron with one atomic proportion of nitrogen and in other instances more than one atomic proportion of nitrogen with one atomic proportion of boron. The nature of the complex is not clearly understood.

Inasmuch as the precise stoichiometry of the complex formation is not known, the relative proportions of the reactants to be used in the process are based primarily upon the consideration of utility of the products for the purposes of this invention. In this regard, useful products are obtained from reaction mixtures in which the reactants are present in relative proportions as to provide from about 0.1 atomic proportions of boron for each mole of the acylated nitrogen composition used to about 10 atomic proportions of boron for each atomic proportion of nitrogen of said acylated nitrogen composition used. The preferred amounts of reactants are such as to provide from about 0.5 atomic proportion of boron for each mole of the acylated nitrogen composition to about 2 atomic proportions of boron for each atomic proportion of nitrogen used., To illustrate, the amount of a boron compound having one boron atom per molecule to be used with one mole of an acylated nitrogen composition having five nitrogen atoms per molecule is within the range from about 0.1 mole to about 50 moles, preferably from about 0.5 mole to about 10 moles.

The nitrogen-containing carboxylic dispersants (C) useful in the lubricating compositions of the present invention also may contain sulfur. In one embodiment, the sulfur-containing carboxylic dispersants are prepared by the reaction of carbon disulfide with (C-3) at least one soluble carboxylic dispersant intermediate prepared by the reaction of a hydrocarbon-substituted succinic acid-producing compound (acylating agent) with at least about one-half equivalent, per equivalent of acid-producing compound, of an amine containing at least one hydrogen attached to a nitrogen atom.

The carboxylic dispersant intermediate (C-3) described above is identical to the oil-soluble nitrogen-containing carboxylic dispersants (C) described above which have not been reacted with carbon disulfide or a boron compound.

Procedures for preparing the carbon disulfide treated carboxylic dispersant intermediates (C-3) have been described previously such as in U.S. Pat. No. 3,200,107.

Generally, at least about 0.5 equivalent of carbon disulfide is reacted with the dispersant intermediate (C-3). When preparing the sulfur- and nitrogen-containing carboxylic dispersants useful in the present invention, the three reactants may be mixed at room temperature and heated to a temperature above 80° C. to effect acylation. The reaction may likewise be carried out by first reacting the amine with carbon disulfide and then acylating the intermediate product with the dicarboxylic acid, or by acylating the amine with a dicarboxylic acid and then reacting the acylated amine with carbon disulfide. The last method of carrying out the process is preferred. The acylation reaction requires a temperature of at least about 80° C. and more preferably between about 150°-250° C.

The relative proportions of the reactants used in the preparation of the sulfur- and nitrogen-containing carboxylic dispersants are based upon the stoichiometry of the reaction involved in the process. The minimum amounts of the dicarboxylic acid and the carbon disulfide to be used are one equivalent of the dicarboxylic acid (one mole contains two equivalents) and about 0.5 equivalent of the carbon disulfide (one mole contains two equivalents) for each mole of the amine used. The maximum amounts of these two reactants to be used are based upon the total number of equivalents of the alkylene amine used. In this respect, it will be noted that one mole of the alkylene amine contains as many equivalents as there are nitrogen atoms in the molecule. Thus, the maximum combined equivalents of dicarboxylic acid in carbon disulfide which can react with one mole of alkylene amine is equal to the number of nitrogen atoms in the alkylene amine molecule. It has been found that the products having particularly usefulness in the present invention are those obtained by the use of dicarboxylic acid and carbon disulfide in relative amounts within the limits of ratio of equivalents of from about 1:3 to about 3:1. A specific example illustrating the limits of the relative proportions of the reactants is as follows: one mole of a tetraalkylene pentamine is reacted with from 1 to 4.5 equivalents, preferably from about 1 to 3 equivalents, of dicarboxylic acid and from about 0.5 to 4 equivalents, preferably from 1 to 3 equivalents, of carbon disulfide.

In another embodiment, the nitrogen-containing carboxylic dispersants (C) may be prepared by heating a mixture comprising (C-4) at least one dimercaptothiadiazole, and (C-2) at least one soluble carboxylic dispersant intermediate prepared by the reaction of a hydrocarbon-substituted succinic acid-producing compound (acylating agent) with at least about one-half equivalent, per equivalent of acid-producing compound, of an organic hydroxy compound or an amine containing at least one hydrogen attached to a nitrogen atom, or a mixture of said hydroxy compound and amine.

The carboxylic dispersant intermediate (C-2) is identical to the oil-soluble nitrogen-containing carboxylic dispersants (C-2) described above.

The first essential starting material for the preparation of these compositions is a dimercaptothiadiazole. There are four such compounds possible, which are named and have structural formulae as follows:

2,5-Dimercapto-1,3,4-thiadiazole

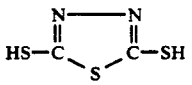

3,5-Dimercapto-1,2,4-thiadiazole

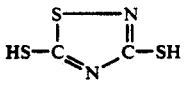

3,4-Dimercapto-1,2,5-thiadiazole

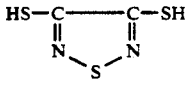

4,5-Dimercapto-1,2,3-thiadiazole

-continued

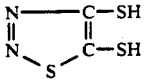

Of these the most readily available, and the one preferred for the purposes of this invention, is 2,5-dimercapto-1,3,4-thiadiazole. This compound will sometimes be referred to hereinafter as DMTD. However, it is to be understood that any of the other dimercaptothiadiazoles may be substituted for all or a portion of the DMTD.

DMTD is conveniently prepared by the reaction of one mole of hydrazine, or a hydrazine salt, with two moles of carbon disulfide in an alkaline medium, followed by acidification. For the preparation of the compositions of this invention, it is possible to utilize already prepared DMTD or to prepare the DMTD in situ, subsequently adding the dispersant or adding the DMTD to the dispersant as described hereinafter.

The compositions of this invention are formed by preparing a mixture of DMTD with the dispersant and heating said mixture within the temperature range of at least 100° C. and usually from about 100°-250° C., for a period of time sufficient to provide a product which is capable of forming a homogeneous blend with an oleaginous liquid of lubricating viscosity, usually with a lubricating oil such as the natural and synthetic lubricants described hereinafter. The mixture will usually also contain an organic liquid diluent which may be either polar or non-polar. Suitable polar liquids include alcohols, ketones, esters and the like. As non-polar liquids there may be used petroleum fractions, ordinarily high-boiling distillates such as mineral oils of lubricating viscosity, as well as naphthas and intermediate fractions (e.g., gas oil, fuel oil or the like). Also suitable are aromatic hydrocarbons, especially the higher boiling ones such as xylene and various minimally volatile alkylaromatic compounds. Halogenated hydrocarbons such as chlorobenzene may also be used.

It is preferred to use the above-described oleaginous liquids of lubricating viscosity as diluents, since this permits the direct use of the composition as a lubricant or a concentrate for incorporation in lubricants.

In a particularly preferred embodiment, the non-polar organic liquid diluent is mineral oil of lubricating viscosity. It is also contemplated, though not preferred, to use a volatile liquid initially and subsequently replace it by mineral oil, with the volatile liquid being removed by distillation, vacuum stripping or the like or to dissolve the DMTD in a volatile polar liquid such as an alcohol and to add the resulting solution to the dispersant-oil mixture, removing the volatile liquid by flash stripping or other evaporation methods.

The relative amounts of dispersant and DMTD may vary widely, as long as a homogeneous product is ultimately obtained. Thus, about 0.1 to 10 parts by weight of dispersant may be used per part of DMTD. More often, about 5 to 10 parts of dispersant are used per part of DMTD. The product usually contains DMTD moieties in amounts substantially greater than the stoichiometric amount based on salt formation. If the dispersant is neutral or acidic there is, of course, no "stoichicmetric amount" of DMTD and any amount thereof in the product is present in excess. If the dispersant is basic, the product usually contains at least about a five-fold excess and may contain a 500-fold or even greater excess of DMTD moieties, based on the stoichiometric amount.

The precise chemical nature of these compositions is not known. In particular, it is not certain whether a chemical reaction takes place between the DMTD and the dispersant. However, it has been shown that DMTD may be dispersed to form a homogeneous composition at lower temperatures than those prescribed for the formation of the compositions of this invention.

When the former compositions is heated, a solid product precipitates and upon further heating at a higher temperature, it is redispersed to form a stable, homogeneous composition. Hydrogen sulfide evolution is noted as the product precipitates when the temperature is raised. It is believed that the initial stage in this process is the homogenization of DMTD by the dispersant, and that the DMTD subsequently condenses to form dimers and other oligomers which first precipitate and are then redispersed as the temperature rises. Since the normal operating temperatures of an internal combustion engine are higher than the temperature of precipitation, the dispersions first formed are not stable enough to serve as lubricant additives, and it is necessary to go through the precipitation and redispersion steps to form an additive of this invention.

Further details of the preparation of other examples of carboxylic dispersants reacted with DMTD are contained in U.S. Pat. No. 4,136,043, the disclosure of which is hereby incorporated by reference.

The following examples are illustrative of the process for preparing the carboxylic dispersants useful in this invention:

EXAMPLE C-1

A polyisobutenyl succinic anhydride is prepared by the reaction of a chlorinated polyisobutylene with maleic anhydride at 200° C. The polyisobutenyl group has an average molecular weight of 850 and the resulting alkenyl succinic anhydride is found to have an acid number of 113 (corresponding to an equivalent weight of 500). To a mixture of 500 grams (1 equivalent) of this polyisobutenyl succinic anhydride and 160 grams of toluene there is added at room temperature 35 grams (1 equivalent) of diethylene triamine. The addition is made portionwise throughout a period of 15 minutes, and an initial exothermic reaction caused the temperature to rise to 50° C. The mixture then is heated and a water-toluene azeotrope distilled from the mixture. When no more water distills, the mixture is heated to 150° C. at reduced pressure to remove the toluene. The residue is diluted with 350 grams of mineral oil and this solution is found to have a nitrogen content of 1.6%.

EXAMPLE C-2

The procedure of Example C-1 is repeated using 31 grams (1 equivalent) of ethylene diamine as the amine reactant. The nitrogen content of the resulting product is 1.4%.

EXAMPLE C-3

The procedure of Example C-1 is repeated using 55.5 grams (1.5 equivalents) of an ethylene amine mixture having a composition corresponding to that of triethylene tetramine. The resulting product has a nitrogen content of 1.9%.

EXAMPLE C-4

The procedure of Example C-1 is repeated using 55.0 grams (1.5 equivalents) of triethylene tetramine as the amine reactant. The resulting product has a nitrogen content of 2.9%.

EXAMPLE C-5

An acylated nitrogen composition is prepared according to the procedure of Example C-1 except that the reaction mixture consists of 3880 grams of the polyisobutenyl succinic anhydride, 376 grams of a mixture of triethylene tetramine and diethylene triamine (75:25 weight ratio), and 2785 grams of mineral oil. The product is found to have a nitrogen content of 2%.

EXAMPLE C-6

A mixture of 510 parts (0.28 mole) of polyisobutene (Mn=1845; Mw=5325) and 59 parts (0.59 mole) of maleic anhydride is heated to 110° C. This mixture is heated to 190° C. in 7 hours during which 43 parts (0.6 mole) of gaseous chlorine is added beneath the surface. At 190°-192° C. an additional 11 parts (0.16 mole) of chlorine is added over 3.5 hours. The reaction mixture is stripped by heating at 190°-193° C. with nitrogen blowing for 10 hours. The residue is the desired polyisobutene-substituted succinic acylating agent having a saponification equivalent number of 87 as determined by ASTM procedure D-94.

A mixture is prepared by the addition of 10.2 parts (0.25 equivalent) of a commercial mixture of ethylene polyamines having from about 3 to about 10 nitrogen atoms per molecule to 113 parts of mineral oil and 161 parts (0.25 equivalent) of the substituted succinic acylating agent at 130° C. The reaction mixture is heated to 150° C. in 2 hours and stripped by blowing with nitrogen. The reaction mixture is filtered to yield the filtrate as an oil solution of the desired product.

EXAMPLE C-7

A mixture of 1000 parts (0.495 mole) of polyisobutene (Mn=2020; Mw=6049) and 115 parts (1.17 moles) of maleic anhydride is heated to 110° C. This mixture is heated to 184° C. in 6 hours during which 85 parts (1.2 moles) of gaseous chlorine is added beneath the surface. At 184°-189° C., an additional 59 parts (0.83 mole) of chlorine is added over 4 hours. The reaction mixture is stripped by heating at 186°-190° C. with nitrogen blowing for 26 hours. The residue is the desired polyisobutene-substituted succinic acylating agent having a saponification equivalent number of 87 as determined by ASTM procedure D-94.

A mixture is prepared by the addition of 57 parts (1.38 equivalents) of a commercial mixture of ethylene polyamines having from about 3 to 10 nitrogen atoms per molecule to 1067 parts of mineral oil and 893 parts (1.38 equivalents) of the substituted succinic acylating agent at 140°-145° C. The reaction mixture is heated to 155° C. in 3 hours and stripped by blowing with nitrogen. The reaction mixture is filtered to yield the filtrate as an oil solution of the desired product.

EXAMPLE C-8

A mixture of 62 grams (1 atomic proportion of boron) of boric acid and 1645 grams (2.35 atomic proportions of nitrogen) of the acylated nitrogen composition obtained by the process of Example C-5 is heated at 150° C. in nitrogen atmosphere for 6 hours. The mixture is then filtered and the filtrate is found to have a nitrogen content of 1.94% and a boron content of 0.33%.

EXAMPLE C-9

An oleyl ester of boric acid is prepared by heating an equi-molar mixture of oleyl alcohol and boric acid in toluene at the reflux temperature while water is removed azeotropically. The reaction mixture is then heated to 150° C./20 mm. and the residue is the ester having a boron content of 3.2% and a saponification number of 62. A mixture of 344 grams (1 atomic proportion of boron) of the ester and 1645 grams (2.35 atomic proportions of nitrogen) of the acylated nitrogen composition obtained by the process of Example C-5 is heated at 150° C. for 6 hours and then filtered. The filtrate is found to have a boron content of 0.6% and a nitrogen content of 1.74%.

EXAMPLE C-10

A mixture of 62 parts of boric acid and 2720 parts of the oil solution of the product prepared in Example C-7 is heated at 150° C. under nitrogen for 6 hours. The reaction mixture is filtered to yield the filtrate as an oil solution of the desired boron-containing product.

EXAMPLE C-11

An oleyl ester of boric acid is prepared by heating an equimolar mixture of oleyl alcohol and boric acid in toluene at the reflux temperature while water is removed azeotropically. The reaction mixture is then heated to 150° C. under vacuum and the residue is the ester having a boron content of 3.2% and a saponification number of 62. A mixture of 344 parts of the ester and 2720 parts of the oil solution of the product prepared in Example C-7 is heated at 150° C. for 6 hours and then filtered. The filtrate is an oil solution of the desired boron-containing product.

EXAMPLE C-12

A substantially hydrocarbon-substituted succinic anhydride is prepared by chlorinating a polyisobutene having a molecular weight of 1000 to a chlorine content of 4.5% and then heating the chlorinated polyisobutene with 1.2 molar proportions of maleic anhydride at a temperature of 150°-220° C. The succinic anhydride thus obtained has an acid number of 130. A mixture of 874 grams (1 mole) of the succinic anhydride and 104 grams (1 mole) of neopentyl glycol is mixed at 240°-250° C./30 mm. for 12 hours. The residue is a mixture of the esters resulting from the esterification of one and both hydroxy radicals of the glycol. It has a saponification number of 101 and an alcoholic hydroxyl content of 0.2%.

EXAMPLE C-13

The substantially hydrocarbon-substituted succinic anhydride of Example C-12 is partially esterified with an ether-alcohol as follows. A mixture of 550 grams (0.63 mole) of the anhydride and 190 grams (0.32 mole) of a commercial polyethylene glycol having a molecular weight of 600 is heated at 240°-250° C. for 8 hours at atmospheric pressure and 12 hours at a pressure of 30 mm. Hg. until the acid number of the reaction mixture is reduced to 28. The residue is an acidic ester having a saponification number of 85.

EXAMPLE C-14

A mixture of 645 grams of the substantially hydrocarbon-substituted succinic anhydride prepared as is described in Example C-12 and 44 grams of tetramethylene glycol is heated at 100°-130° C. for 2 hours. To this mixture there is added 51 grams of acetic anhydride (esterification catalyst) and the resulting mixture is heated under reflux at 130°-160° C. for 2.5 hours. Thereafter the volatile components of the mixture are distilled by heating the mixture to 196°-270° C./30 mm. and then at 240° C./0.15 mm. for 10 hours. The residue is an acidic ester having a saponification number of 121 and an acid number of 58.

EXAMPLE C-15

A mixture of 456 grams of a polyisobutene-substituted succinic anhydride prepared as is described in Example C-12 and 350 grams (0.35 mole) of the monophenyl ether of a polyethylene glycol having a molecular weight of 1000 is heated at 150°-155° C. for 2 hours. The product is an ester having a saponification number of 71, an acid number of 53, and an alcoholic hydroxyl content of 0.52%.

EXAMPLE C-16

A partial ester of sorbitol is obtained by heating a xylene solution containing the substantially hydrocarbon-substituted succinic anhydride of Example C-12 and sorbitol (0.5 mole per mole of the anhydride) at 150°-155° C. for 6 hours while water is removed by azeotropic distillation. The residue is filtered and the filtrate is heated at 170° C./11 mm. to distill off volatile components. The residue is an ester having a saponification number of 97 and an alcoholic hydroxyl content of 1.5%.

EXAMPLE C-17

To a mixture of 1750 parts of a mineral oil and 3500 parts (6.5 equivalents) of a polyisobutene-substituted succinic anhydride having an acid number of 104 prepared by the reaction of maleic anhydride with a chlorinated polyisobutene having a molecular weight of 1000 and a chlorine content of 4.5%, there is added at 70°-100° C., 946 parts (25.9 equivalents) of triethylene tetramine. The reaction is exothermic. The mixture is heated at 160°-170° C. for 12 hours while nitrogen is passed through the mixture, whereupon 59 cc. of water is collected as the distillate. The mixture is diluted with 1165 parts of mineral oil and filtered. The filtrate is found to have a nitrogen content of 4.12%. To 6000 parts of the above acylated product, there is added 608 parts (16 equivalents) of carbon disulfide at 25°-50° C. throughout a period of 2 hours. The mixture is heated at 60°-73° C. for 3 hours and then at 68°-85° C./7 mm. Hg. for 5.5 hours. The residue is filtered at 85° C. and the filtrate is found to have a nitrogen content of 4.45% and a sulfur content of 4.8%.

EXAMPLE C-18

The product of Example C-17 is heated at 150°-180° C. for 4.5 hours and filtered. The filtrate is found to have a nitrogen content of 3.48% and a sulfur content of 2.48%.

EXAMPLE C-19

An alkylene amine mixture consisting of 34% (by weight) of a commercial ethylene amine mixture having an average composition corresponding to that of tetraethylene pentamine, e.g., 8% of diethylene triamine, and 24% of triethylene tetramine (459 parts, 11.2 equivalents) is added to 4000 parts (7.4 equivalents) of the polyisobutene-substituted succinic anhydride for Example C-17 and 2000 parts of mineral oil at 61°-88° C. The mixture is heated at 150°-160° C. for 6 hours while being purged with nitrogen. A total of 75 cc. of water is collected as the distillate during the period. The residue is diluted with 913 parts of mineral oil, heated to 160° C. and filtered. The filtrate is found to have a nitrogen content of 2.15%. To 6834 parts of the above filtrate there is added 133 parts (3.5 equivalents) of carbon disulfide at 22°-30° C. throughout a period of 1 hour. The mixture is heated at 50°-72° C. for 2.5 hours and then to 90° C./15 mm. The residue is found to have a nitrogen content of 2.13% and a sulfur content of 1.41%.

EXAMPLE C-20

The product of Example C-19 is heated at 120°-160° C. for 4 hours and filtered. The filtrate is found to have a nitrogen content of 2.14% and a sulfur content of 0.89%.

EXAMPLE C-21

A mixture of 508 parts (12 equivalents) of Polyamine H and 152 parts (4 equivalents) of carbon disulfide is prepared at 25°-60° C., heated to 190° C. in 3 hours and at 190°-210° C. for 10 hours. The mixture is then purged with nitrogen at 200° C. for 1 hour. The residue is found to have a nitrogen content of 29.7% and a sulfur content of 6.5%. The above product (95 parts) is added to a solution of 1088 parts (2 equivalents) of the polyisobutene-substituted succinic anhydride of Example C-17 in 600 cc. of toluene at 70°-80° C. in 10 minutes. The mixture is heated at 127° C. for 8 hours whereupon 10.6 cc. of water is removed by azeotropic distillation with toluene. The residue is heated at 150° C. to remove toluene, diluted with 783 parts of mineral oil and heated again to 152° C./13 mm. The residue is found to have a nitrogen content of 1.48% and a sulfur content of 0.43%.

EXAMPLE C-22

A carboxylic dispersant is prepared by reacting a polyisobutenyl (molecular weight of about 900) succinic anhydride prepared from chlorinated polyisobutene with a polyethylene mixture containing about 3-7 amino groups per molecule in an equivalent ratio of 1.33. The reaction temperature is about 150° C. The dispersant prepared in this manner is substantially neutral (base number of 6).

Six-thousand parts of the above-prepared dispersant (0.64 equivalent of base) is heated to 100° C., and 484 parts of wet DMTD (420 parts on a dry basis, or 5.6 equivalents) is added over 15 minutes, with stirring. The mixture is heated at 110°-120° C. for 6 hours under nitrogen, during which time hydrogen sulfide evolution is noted. Mineral oil, 1200 parts, is added and the mixture is filtered while hot. The filtrate is a 53% solution of the desired product in oil and contains 1.68% nitrogen and 2.83% sulfur. The weight ratio of dispersant to DMTD is 8.6.

EXAMPLE C-23

DMTD (5.6 equivalents) is prepared by adding 447 parts of carbon disulfide over 2.75 hours to a mixture of 140 parts of hydrazine hydrate, 224 parts of 50% aqueous sodium hydroxide and 1020 parts of mineral oil, with stirring under nitrogen at 25°-46° C., heating the resulting mixture at 96°-104° C. for about 3 hours, and then cooling to 78° C. and acidifying with 280 parts of 50% aqueous sulfuric acid. The resulting material is heated to 94° C. and 6000 parts of dispersant prepared as in the first paragraph of Example C-22 (0.64 equivalent of base) is added over about 0.5 hour at 90°-94° C., under nitrogen. The mixture is heated gradually to 150° C. and maintained at that temperature for about 3 hours; it is then filtered while hot to yield a 50% solution in mineral oil of the desired product. The solution contains 2.06% nitrogen and 3.26% sulfur, and the weight ratio of dispersant to DMTD therein is 8.6.

EXAMPLE C-24

A carboxylic dispersant is prepared by reacting a polyisobutenyl (molecular weight of about 1100) succinic anhydride prepared from chlorinated polyisobutene with pentaerythritol followed by a polyethylene amine mixture containing about 3-7 amino groups per molecule (ratio of equivalents 7.7:1). The ratio of equivalents of the anhydride to amine mixture is 0.44, and the reaction temperature is about 150°-210° C. The dispersant is substantially neutral.

The above dispersant (730 parts, 0.26 equivalent of base) and 0.125 parts of mineral oil is heated to 95° C. under nitrogen, and 58.8 parts of wet DMTD (51 parts on a dry basis) are added over about 20 minutes. The mixture is heated to 150° C. and maintained at this temperature for about 5 hours and then filtered while hot. The filtrate is the desired product (50% in oil) containing 1.72% nitrogen and 3.08% sulfur. The weight ratio of dispersant to DMTD is 7.86.

EXAMPLE C-25

The procedure of Example C-24 is repeated using 1000 parts of the dispersant (0.036 equivalent of base), 241 parts (3.21 eq.) of DMTD and 210 parts of mineral oil. The product (50% in mineral oil) contains 2.74% nitrogen and 6.79% sulfur. The weight ratio of dispersant to DMTD is 2.62.

EXAMPLE C-26

A mixture of 1000 parts of the dispersant prepared as in the first paragraph of Example C-24 (0.036 equivalent of base) and 170 parts of mineral oil is heated to 70° C., and a solution of 70 parts (0.93 equivalent) of DMTD in 865 parts of isopropyl alcohol is added over about 0.5 hour, with stirring. Heating at 70° C. is continued as the isopropyl alcohol is stripped under vacuum, yielding a homogeneous mixture. This mixture is gradually heated to 155° C.; during the heating, a solid precipitates and a sample thereof is removed and analyzed. Elemental analysis indicates that it is an oligomer of DMTD, principally a dimer.

As heating continues above 140° C., the solid is gradually solubilized to yield a homogeneous product again. This product is the desired material (50% solution in oil) having a dispersant to DMTD weight ratio of 7.86:1.

EXAMPLE C-27

Hydrazine hydrate, 28 parts, is mixed with 45 parts of 50% aqueous sodium hydroxide and 206 parts of mineral oil, and 102 parts of carbon disulfide is added over 2 hours. An exothermic reaction takes place which causes the temperature to rise to 38° C. The mixture is heated to 109° C. and maintained at that temperature for 1 hour, during which time hydrogen sulfide evolution is noted. It is then cooled to 88° C. and 88 parts of 33% aqueous sulfuric acid is added over 0.5 hour. The temperature rises to 90° C. during this addition.

The resulting slurry (1.12 equivalents of DMTD) is added to 1209 parts (0.043 equivalent of base) of a dispersant prepared as in the first paragraph of Example C-24. Volatile materials are removed by vacuum stripping at 150° C. and the remaining mixture is heated to 3 hours at that temperature. The residue is filtered while hot and the filtrate is the desired product containing 1.43% nitrogen and 2.90% sulfur, and having a weight ratio of dispersant to DMTD of 7.86.

The phosphorus- and/or nitrogen-containing derivative compositions of the present invention alone or in admixture with the carboxylic dispersants (C) are useful as additives in normally liquid fuels, lubricants, or functional fluids and in various aqueous systems. Lubricants, fuels and/or functional fluids containing the derivative compositions of the present invention exhibit improved anti-wear, extreme pressure and antioxidant properties. The lubricating compositions may be lubricating oils and greases useful in industrial applications and in automotive engines, transmissions and axles. The functional fluids may be hydrocarbon-based or aqueous-based.

Lubricating and Oil-Based Functional Fluid Compositions

The lubricating and oil-based functional fluid compositions of the present invention are based on diverse oils of lubricating viscosity, including natural and synthetic lubricating oils and mixtures thereof. These lubricating compositions containing the phosphorus- and/or nitrogen-containing derivative compositions of the invention (and optionally the carboxylic dispersant (C)), are effective in a variety of applications including crankcase lubricating oils for spark-ignited and compression-ignited internal combustion engines, including automobile and truck engines, two-cycle engines, aviation piston engines, marine and low-load diesel engines, and the like. Also, automatic transmission fluids, transaxle lubricants, gear lubricants, metal-working lubricants, hydraulic fluids, and other lubricating oil and grease compositions can benefit from the incorporation of the compositions of this invention. The lubricating compositions are particularly effective as gear lubricants.

Oil of Lubricating Viscosity

Natural oils include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_{3-8}$ fatty acid esters, or the $C_{13}$Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methylhexyl)silicate, tetra-(p-tert-butylphenyl) silicate, hexyl-(4-methyl-2-pentoxy)disiloxane, poly(methyl) siloxanes, poly(methylphenyl)siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the lubricants of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

Generally, the lubricants and functional fluids of the present invention contain an amount of the phosphorus- and/or nitrogen-containing derivatives and, optionally, the carboxylic dispersant (C) which is sufficient to provide the lubricants and functional fluids with the desired properties such as improved antioxidant, extreme pressure, thermal stability and/or anti-wear properties. Normally, this amount of additive will be from about 0.01 to about 20% by weight and preferably from about 0.1 to about 10% of the total weight of the lubricant or functional fluid. This amount is exclusive of solvent/diluent medium. In lubricating compositions operated under extremely adverse conditions, such as lubricating compositions for marine diesel engines, the sulfur compounds of this invention may be present in amounts up to about 30% by weight, or more, of the total weight of the lubricating composition. When mixtures of the phosphorus- and/or nitrogen derivative compositions of the sulfur compounds described above, and the carboxylic dispersant (C) are added to lubricants, functional fluids, and fuels, the weight ratio of derivative composition to (C) is from about 0.1:1 to about 10:1.

The invention also contemplates the use of other additives in the lubricating and functional fluid compositions of this invention. Such additives include, for example, detergents and dispersants of the ash-producing or ashless type, corrosion- and oxidation-inhibiting agents, pour point depressing agents, auxiliary extreme pressure and/or antiwear agents, color stabilizers and anti-foam agents.

The ash-producing detergents are exemplified by oil-soluble neutral and basic salts of alkali or alkaline earth metals with sulfonic acids, carboxylic acids, or organic phosphorus acids characterized by at least one direct carbon-to-phosphorus linkage such as those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium.

The term "basic salt" is used to designate metal salts wherein the metal is present in stoichiometrically larger amounts than the organic acid radical. The commonly employed methods for preparing the basic salts involve heating a mineral oil solution of an acid with a stoichiometric excess of a metal neutralizing agent such as the metal oxide, hydroxide, carbonate, bicarbonate, or sulfide at a temperature of about 50° C. and filtering the resulting mass. The use of a "promoter" in the neutralization step to aid the incorporation of a large excess of metal likewise is known. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octyl alcohol, cellosolve, carbitol, ethylene glycol, stearyl alcohol, and cyclohexyl alcohol; and amines such as aniline, phenylenediamine, phenothiazine, phenyl-betanaphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60°-200° C.

Ashless detergents and dispersants are so called despite the fact that, depending on its constitution, the dispersant may upon combustion yield a nonvolatile material such as boric oxide or phosphorus pentoxide; however, it does not ordinarily contain metal and therefore does not yield a metal-containing ash on combustion. Many types are known in the art, and any of them are suitable for use in the lubricant compositions of this invention. The following are illustrative:

(1) Reaction products of relatively high molecular weight aliphatic or alicyclic halides with amines, preferably oxyalkylene polyamines. These may be characterized as "amine dispersants" and examples thereof are described for example, in the following U.S. Patents:

| | |
|---|---|
| 3,275,554 | 3,454,555 |
| 3,438,757 | 3,565,804 |

(2) Reaction products of alkyl phenols in which the alkyl group contains at least about 30 carbon atoms with aldehydes (especially formaldehyde) and amines (especially polyalkylene polyamines), which may be characterized as "Mannich dispersants". The materials described in the following U.S. Patents are illustrative:

| | | |
|---|---|---|
| 2,459,112 | 3,442,808 | 3,591,598 |
| 2,962,442 | 3,448,047 | 3,600,372 |
| 2,984,550 | 3,454,497 | 3,634,515 |
| 3,036,003 | 3,459,661 | 3,649,229 |
| 3,166,516 | 3,461,172 | 3,697,574 |
| 3,236,770 | 3,493,520 | 3,725,277 |
| 3,355,270 | 3,539,633 | 3,725,480 |
| 3,368,972 | 3,558,743 | 3,726,882 |
| 3,413,347 | 3,586,629 | 3,980,569 |

(3) Products obtained by post-treating the amide or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Patents:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,422 |

(4) Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. Patents:

| | |
|---|---|
| 3,329,658 | 3,666,730 |
| 3,449,250 | 3,687,849 |
| 3,519,565 | 3,702,300 |

The above-noted patents are incorporated by reference herein for their disclosures of ashless dispersants.

Auxiliary extreme pressure agents and corrosion- and oxidation-inhibiting agents which may be included in the lubricants and functional fluids of the invention are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phospho-sulfurized hydrocarbons such as the reaction product of a phosphorus sulfide with turpentine or methyl oleate, phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl)-phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

Many of the above-mentioned auxiliary extreme pressure agents and corrosion-oxidation inhibitors also serve as antiwear agents. Zinc dialkylphosphorodithioates are a well known example.

Pour point depressants are a particularly useful type of additive often included in the lubricating oils described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezius-Hiles Co. publishers, Cleveland, Ohio, 1967).

Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are herein incorporated by reference for their relevant disclosures.

Anti-foam agents are used to reduce or prevent the formation of stable foam. Typical anti-foam agents include silicones or organic polymers. Additional anti-foam compositions are described in "Foam Control Agents", by Henry T. Kerner (Noyes Data Corporation, 1976), pages 125–162.

The following examples illustrate the lubricant and functional fluid compositions of the invention.

| | Parts by Wt. | |
|---|---|---|
| Lubricant A | | |
| Base oil | 98 | |
| Product of Example I | 2.00 | |
| Lubricant B | | |
| Base Oil | 97.75 | |
| Product of Example IV | 2.25 | |
| Lubricant C | | |
| Base Oil | 97.50 | |
| Product of Example IX | 2.50 | |
| Lubricant D (ATF) | | |
| Polyisobutylene (Mn 900) | 35 | |
| Product of Example IV | 3.5 | |
| Polyisobutylene succinic anhydride reacted with ethylene polyamine | 1.5 | |
| Commercially available naphthenic oil having a viscosity at 40° C. of about 3.5 CKS | 29 | |
| Product of Example C-27 | 9.52 | |
| Seal sweller prepared as in U.S. Pat. No. 4,029,587 | 1.67 | |
| Silicone antifoam agent | 1.33 | |
| Lubricants E and F (Hydraulic Fluids) | E | F |
| 100 Neutral Mineral Oil | 88.17 | 91.11 |
| Product of Example IV | 1.10 | 0.85 |
| Reaction product of ethylene polyamine with polyisobutenyl succinic anhydride followed by boric acid | 0.70 | 0.50 |
| Polyisobutylene (Mn = 1400) | 6.52 | 4.89 |
| Alkylate 230 (a product of Monsanto identified as an alkylated benzene having a molecular weight of about 260) | 1.61 | 1.21 |
| Acryloid 150 (a product of Rohm & Haas identified as a methacrylate copolymer) | 0.081 | 0.060 |
| Acryloid 156 (a product of Rohm & Haas identified as a methacrylate copolymer) | 0.238 | 0.179 |
| Zinc di(2-ethylhexyl) dithiophosphate | 0.53 | 0.371 |
| Sodium petroleum sulfonate | 0.03 | 0.0506 |
| Antioxidant 732 (product of Ethyl identified as alkylated phenol) | 0.18 | 0.151 |
| Tolad 370 (product of Petrolite identified as a solution of a polyglycol in aromatic hydrocarbons) | 0.008 | 0.01 |
| Sulfurized calcium salt of dodecyl phenol | 0.07 | 0.05 |
| Tolyltriazole | 0.001 | 0.00165 |
| Acrylate terpolymer derived from 2-ethylhexyl acrylate, ethyl acrylate and vinyl acetate | — | 0.015 |
| Diluent oil | 0.76 | 0.569 |

The lubricant compositions of the present invention may be in the form of lubricating oils and greases in which any of the above-described oils of lubricating viscosity can be employed as a vehicle. Where the lubricant is to be used in the form of a grease, the lubricating oil generally is employed in an amount sufficient to balance the total grease composition and generally, the grease compositions will contain various quantities of thickening agents and other additive components to provide desirable properties. The greases will contain effective amounts of the phosphorus- and/or nitrogen-containing derivative compositions described above, alone or in combination with the carboxylic dispersants (C) described above. Generally, the greases will contain from about 0.01 to about 20–30% of the derivative composition of the invention.

A wide variety of thickening agents can be used in the preparation of the greases of this invention. Included among the thickening agents are alkali and alkaline earth metal soaps of fatty acids and fatty materials having from about 12 to about 30 carbon atoms. The metals are typified by sodium, lithium, calcium and barium. Examples of fatty materials include stearic acid, hydroxy stearic acid, stearin, oleic acid, palmetic acid, myristic acid, cottonseed oil acids, and hydrogenated fish oils.

Other thickening agents include salt and saltsoap complexes as calcium stearate-acetate (U.S. Pat. No. 2,197,263), barium stearate acetate (U.S. Pat. No. 2,564,561), calcium stearate-caprylate-acetate complexes (U.S. Pat. No. 2,999,065), calcium caprylate-acetate (U.S. Pat. No. 2,999,066), and calcium salts and soaps of low-, intermediate- and high-molecular weight acids and of nut oil acids.

Particularly useful thickening agents employed in the grease compositions are essentially hydrophilic in character, but which have been converted into a hydrophobic condition by the introduction of long chain hydrocarbon radicals onto the surface of the clay particles prior to their use as a component of a grease composition, as, for example, by being subjected to a preliminary treatment with an organic cationic surface-active agent, such as an onium compound. Typical onium compounds are tetraalkylammonium chlorides, such as dimethyl dioctadecyl ammonium chloride, dimethyl dibenzyl ammonium chloride and mixtures thereof. This method of conversion, being well known to those skilled in the art, and is believed to require no further discussion. More specifically, the clays which are useful as starting materials in forming the thickening agents to be employed in the grease compositions, can comprise the naturally occurring chemically unmodified clays. These clays are crystalline complex silicates, the exact composition of which is not subject to precise description,. since they vary widely from one natural source to another. These clays can be described as complex inorganic silicates such as aluminum silicates, magnesium silicates, barium silicates, and the like, containing, in addition to the silicate lattice, varying amounts of cation-exchangeable groups such as sodium. Hydrophilic clays which are particularly useful for conversion to desired thickening agents include montmorillonite clays, such as bentonite, attapulgite, hectorite, illite, saponite, sepiolite, biotite, vermiculite, zeolite clays, and the like. The thickening agent is employed in an amount from about 0.5 to about 30, and preferably from 3% to 15% by weight of the total grease composition.

The fuel compositions of the present invention contain a major proportion of a normally liquid fuel, usually a hydrocarbonaceous petroleum distillate fuel such as motor gasoline as defined by ASTM Specification D439 and diesel fuel or fuel oil as defined by ASTM Specification D396. Normally liquid fuel compositions comprising non-hydrocarbonaceous materials such as alcohols, ethers, organo-nitro compounds and the like (e.g., methanol, ethanol, diethyl ether, methyl ethyl ether, nitromethane) are also within the scope of this invention as are liquid fuels derived from vegetable or mineral sources such as corn, alfalfa, shale and coal. Normally liquid fuels which are mixtures of one or more hydrocarbonaceous fuels and one or more non-hydrocarbonaceous materials are also contemplated. Examples of such mixtures are combinations of gasoline and ethanol and of diesel fuel and ether. Particularly preferred is gasoline, that is, a mixture of hydrocarbons having an ASTM distillation range from about 60° C. at the 10% distillation point to about 205° C. at the 90% distillation point.

Generally, these fuel compositions contain a property improving amount of the phosphorus- and/or nitrogen-containing derivative compositions and optionally the carboxylic dispersant (C) of this invention. Usually this amount is about 1 to about 50,000 parts by weight, preferably about 4 to about 5000 parts, of the composition of this invention per million parts of fuel.

The fuel compositions can contain, in addition to the composition of this invention, other additives which are well known to those of skill in the art. These include anti-knock agents such as tetraalkyl lead compounds, lead scavengers such as haloalkanes (e.g., ethylene dichloride and ethylene dibromide), deposit preventers or modifiers such as triaryl phosphates, dyes, cetane improvers, antioxidants such as 2,6-ditertiary-butyl-4-methyl-phenol, rust inhibitors such as alkylated succinic acids and anhydrides, bacteriostatic agents, gum inhibitors, metal deactivators, demulsifiers, upper cylinder lubricants and anti-icing agents.

The compositions of this invention can be added directly to the lubricants, functional fluids and fuels, or they can be diluted with a substantially inert, normally liquid organic solvent/diluent such as naphtha, benzene, toluene, xylene or a normally liquid fuel as described above, to form an additive concentrate. These concentrates generally contain from about 30% to about 90% by weight of the composition of this invention and may contain, in addition one or more other conventional additives known in the art or described hereinabove.

The invention also includes aqueous compositions characterized by an aqueous phase with at least one of the phosphorus- and/or nitrogen-containing derivative compositions of the invention dispersed or dissolved in said aqueous phase. Preferably, this aqueous phase is a continuous aqueous phase, although in some embodiments the aqueous phase can be a discontinuous phase. These aqueous compositions usually contain at least about 25% by weight water. Such aqueous compositions encompass both concentrates containing about 25% to about 80% by weight, preferably from about 40% to about 65% water; and water-based functional fluids containing generally over about 80% by weight of water. The concentrates generally contain from about 10% to about 90% by weight of the derivative compositions. The water-based functional fluids generally contain from about 0.05% to about 15% by weight of the derivative compositions. The concentrates generally contain less than about 50%, preferably less than about 25%, more preferably less than about 15%, and still more preferably less than about 6% hydrocarbon oil. The water-based functional fluids generally contain less than about 15%, preferably less than about 5%, and more preferably less than about 2% hydrocarbon oil.

These aqueous concentrates and water-based functional fluids can optionally include other conventional additives commonly employed in water-based functional fluids. These other additives include surfactants; thickeners; oil-soluble, water-insoluble functional additives such as anti-wear agents, extreme pressure agents, dispersants, etc.; and supplemental additives such as corrosion-inhibitors, shear stabilizing agents, bactericides, dyes, water-softeners, odor masking agents,, antifoam agents and the like.

The concentrates are analogous to the water-based functional fluids except that they contain less water and proportionately more of the other ingredients. The concentrates can be converted to water-based functional fluids by dilution with water. This dilution is usually done by standard mixing techniques. This is often a convenient procedure since the concentrate can be shipped to the point of use before additional water is added. Thus, the cost of shipping a substantial amount of the water in the final water-based functional fluid is saved. Only the water necessary to formulate the concentrate (which is determined primarily by ease of handling and convenience factors), need be shipped.

Generally these water-based functional fluids are made by diluting the concentrates with water, wherein the ratio of water to concentrate is usually in the range of about 80:20 to about 99:1 by weight. As can be seen when dilution is carried out within these ranges, the final water-based functional fluid contains, at most, an insignificant amount of hydrocarbon oil.

In various preferred embodiments of the invention, the water-based functional fluids are in the form of solutions while in other embodiments they are in the form of micelle dispersions or microemulsions which appear to be true solutions. Whether a solution, micelle dispersion or microemulsion is formed is dependent, inter alia, on the particular components employed.

Also included within this invention are methods for preparing aqueous compositions, including both concentrates and water-based functional fluids, containing other conventional additives commonly employed in, water-based functional fluids. These methods comprise the steps of:

(1) mixing the phosphorus- and/or nitrogen-containing derivative compositions of the invention, or a mixture of said derivative compositions and the carboxylic dispersant (C) with such other conventional additives either simultaneously or sequentially to form a dispersion or solution; optionally (2) combining said dispersion or solution with water to form said aqueous concentrate; and/or (3) diluting said dispersion or solution, or concentrate with water wherein the total amount of water used is in the amount required to provide the desired concentration of the components of the invention and other functional additives in said concentrates or said water-based functional fluids.

These mixing steps are preferably carried out using conventional equipment and generally at room or slightly elevated temperatures, usually below 100° C. and often below 50° C. As noted above, the concentrate can be formed and then shipped to the point of use where it is diluted with water to form the desired water-based functional fluid. In other instances the finished water-based functional fluid can be formed directly in the same equipment used to form the concentrate or the dispersion or solution.

The surfactants that are useful in the aqueous compositions of the invention can be of the cationic, anionic, nonionic or amphoteric type. Many such surfactants of each type are known to the art. See, for example, McCutcheon's "Emulsifiers & Detergents", 1981, North American Edition, published by McCutcheon Division, MC Publishing Co., Glen Rock, New Jersey, U.S.A., which is hereby incorporated by reference for its disclosures in this regard.

Among the nonionic surfactant types are the alkylene oxide-treated products, such as ethylene oxide-treated phenols, alcohols, esters, amines and amides. Ethylene oxide/propylene oxide block copolymers are also useful nonionic surfactants. Glycerol esters and sugar esters are also known to be nonionic surfactants. A typical nonionic surfactant class useful with the present invention are the alkylene oxide-treated alkyl phenols such as the ethylene oxide alkyl phenol condensates sold by the Rohm & Haas Company. A specific example of these is Triton X-100 which contains an average of 9–10 ethylene oxide units per molecule, has an HLB value of about 13.5 and a molecular weight of about 628. Many other suitable nonionic surfactants are known; see, for example, the aforementioned McCutcheon's as well as the treatise "Non-Ionic Surfactants" edited by Martin J. Schick, M. Dekker Co., New York, 1967, which is herein incorporated by reference for its disclosures in this regard.

As noted above, cationic, anionic and amphoteric surfactants can also be used. Generally, these are all hydrophilic surfactants. Anionic surfactants contain negatively charged polar groups while cationic surfactants contain positively charged polar groups. Amphoteric dispersants contain both types of polar groups in the same molecule. A general survey of useful surfactants is found in Kirk-Othmer Encyclopedia of Chemical Technology, Second Edition, Volume 19, page 507 et seq. (1969, John Wiley and Son, New York) and the aforementioned compilation published under the name of McCutcheon's. These references are both hereby incorporated by, reference for their disclosures relating to cationic, amphoteric and anionic surfactants.

Among the useful anionic surfactant types are the widely known carboxylate soaps, organo sulfates, sulfonates, sulfocarboxylic acids and their salts, and phosphates. Useful cationic surfactants include nitrogen compounds such as amine oxides and the well-known quaternary ammonium salts. Amphoteric surfactants include amino acid-type materials and similar types. Various cationic, anionic and amphoteric dispersants are available from the industry, particularly from such companies as Rohm & Haas and Union Carbide Corporation, both of America. Further information about anionic and cationic surfactants also can be found in the texts "Anionic Surfactants", Parts II and III, edited by W. M. Linfield, published by Marcel Dekker, Inc., New York, 1976 and "Cationic Surfactants", edited by E. Jungermann, Marcel Dekker, Inc., New York, 1976. Both of these references are incorporated by reference for their disclosures in this regard.

These surfactants, when used, are generally employed in effective amounts to aid in the dispersal of the various additives, particularly the functional additives discussed below, in the concentrates and water-based functional fluids of the invention. Preferably, the concentrates can contain up to about 75% by weight, more preferably from about 10% to about 75% by weight of one or more of these surfactants. The water-based functional fluids can contain up to about 15% by weight, more preferably from about 0.05% to about 15% by weight of one or more of these surfactants.

Often the aqueous compositions of this invention contain at least one thickener for thickening said compositions. Generally, these thickeners can be polysaccharides, synthetic thickening polymers, or mixtures of two or more of these. Among the polysaccharides that are useful are natural gums such as those disclosed in "Industrial Gums" by Whistler and B. Miller, published by Academic Press, 1959. Disclosures in this book relating to water-soluble thickening natural gums is hereby incorporated by reference. Specific examples of such gums are gum agar, guar gum, gum arabic, algin, dextrans, xanthan gum and the like. Also among the polysaccharides that are useful as thickeners for the aqueous compositions of this invention are cellulose ethers and esters, including hydroxy hydrocarbyl cellulose and hydrocarbylhydroxy cellulose and its salts. Specific examples of such thickeners are hydroxyethyl cellulose and the sodium salt of carboxymethyl cellulose. Mixtures of two or more of any such thickeners are also useful.

It is a general requirement that the thickener used in the aqueous compositions of the present invention be soluble in both cold (10° C.) and hot (about 90° C.) water. This excludes such materials as methyl cellulose which is soluble in cold water but not in hot water. Such hot-water-insoluble materials, however, can be used to perform other functions such as providing lubricity to the aqueous compositions of this invention.

These thickeners can also be synthetic thickening polymers. Many such polymers are known to those of skill in the art. Representative of them are polyacrylates, polyacrylamides, hydrolyxed vinyl esters, water-soluble homo- and interpolymers of acrylamidoalkane sulfonates containing 50 mole percent at least of acryloamido alkane sulfonate and other comonomers such as acrylonitrile, styrene and the like. Poly-n-vinyl pyrrolidones, homo- and copolymers as well as water-soluble salts of styrene, maleic anhydride and isobutylene maleic anhydride copolymers can also be used as thickening agents.

Other useful thickeners are known to those of skill in the art and many can be found in the list in the aforementioned McCutcheon Publication: "Functional Materials," 1976, pp. 135–147, inclusive. The disclosures therein, relative to water-soluble polymeric thickening agents meeting the general requirements set forth above are hereby incorporated by reference.

Preferred thickeners, particularly when the compositions of the invention are required to be stable under high shear applications, are the water-dispersible reaction products formed by reacting at least one hydrocarbyl-substituted succinic acid and/or anhydride represented by the formula

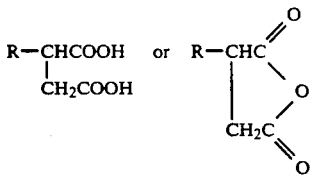

wherein R is a hydrocarbyl group of from about 8 to about 40 carbon atoms, with at least one water-dispersible amine terminated poly(oxyalkylene) or at least one water-dispersible hydroxy-terminated polyoxyalkylene. R preferably has from about 8 to about 30 carbon atoms, more preferably from about 12 to about 24 carbon atoms, still more preferably from about 16 to about 18 carbon atoms. In a preferred embodiment, R is represented by the formula

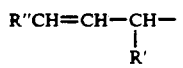

wherein R′ and R″ are independently hydrogen or straight chain or substantially straight chain hydrocarbyl groups, with the proviso that the total number of carbon atoms in R is within the above-indicated ranges. Preferably R′ and R″ are alkyl or alkenyl groups. In a particularly advantageous embodiment, R has from about 16 to about 18 carbon atoms, R′ is hydrogen or an alkyl group of from 1 to about 7 carbon atoms or an alkenyl group of from 2 to about 7 carbon atoms, and R″ is an alkyl or alkenyl group of from about 5 to about 15 carbon atoms.

The water-dispersible amine terminated poly(oxyalkylene)s are preferably alpha omega diamino poly(oxyethylene)s, alpha omega diamino poly(oxypropylene) poly(oxyethylene) poly(oxypropylene)s or alpha omega diamino propylene oxide capped poly(oxyethylene)s. The amine-terminated poly(oxyalkylene) can also be a urea condensate of such alpha omega diamino poly(oxyethylene)s, alpha omega diamino poly(oxypropylene) poly(oxyethylene) poly(oxypropylene)s or alpha omega diamino propylene oxide capped poly(oxyethylene)s. The amine-terminated poly(oxyalkylene) can also be a polyamino (e.g., triamino, tetramino, etc.) polyoxyalkylene provided it is amine-terminated and it is water-dispersible.

Examples of water-dispersible amine-terminated poly(oxyalkylene)s that are useful in accordance with the present invention are disclosed in U.S. Pat. Nos. 3,021,232; 3,108,011; 4,444,566; and Re 31,522. The disclosures of these patents are incorporated herein by reference. Water-dispersible amine terminated poly(oxyalkylene)s that are useful are commercially available from the Texaco Chemical Company under the trade name Jeffamine.

The water-dispersible hydroxy-terminated polyoxyalkylenes are constituted of block polymers of propylene oxide and ethylene oxide, and a nucleus which is derived from organic compounds containing a plurality of reactive hydrogen atoms. The block polymers are attached to the nucleus at the sites of the reactive hydrogen atoms. Examples of these compounds include the hydroxy-terminated polyoxyalkylenes which are represented by the formula

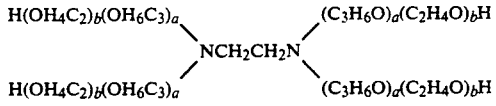

wherein a and b are integers such that the collective molecular weight of the oxypropylene chains range from about 900 to about 25,000, and the collective weight of the oxyethylene chains constitute from about 20% to about 90%, preferably from about 25% to about 55% by weight of the compound. These compounds are commercially available from BASF Wyandotte Corporation under the tradename "Tetronic". Additional examples include the hydroxy-terminated polyoxyalkylenes represented by the formula $$HO(C_2H_4O)_x(C_3H_6O)_y(C_2H_4O)_zH$$

wherein y is an integer such that the molecular weight of the oxypropylene chain is at least about 900, and x and z are integers such that the collective weight of the oxyethylene chains constitute from about 20% to about 90% by weight of the compound. These compounds preferably have a molecular weight in the range of about 100 to about 14,000. These compounds are commercially available from BASF Wyandotte Corporation under the tradename "Pluronic". Useful hydroxy-terminated polyoxyalkylenes are disclosed in U.S. Pat. Nos. 2,674,619 and 2,979,528, which are incorporated herein by reference.

The reaction between the carboxylic agent and the amine- or hydroxy-terminated polyoxyalkylene can be carried out at a temperature ranging from the highest of the melt temperatures of the reaction components up to the lowest of the decomposition temperatures of the reaction components or products. Generally, the reaction is carried out at a temperature in the range of about 60° C. to about 160° C., preferably about 120° C. to about 160° C. The ratio of equivalents of carboxylic agent to polyoxyalkylene preferably ranges from about 0.1:1 to about 8:1, preferably about 1:1 to about 4:1, and advantageously about 2:1. The weight of an equivalent of the carboxylic agent can be determined by dividing its molecular weight by the number of carboxylic functions present. The weight of an equivalent of the amine-terminated polyoxyalkylene can be determined by dividing its molecular weight by the number of terminal amine groups present. The weight of an equivalent of the hydroxy-terminated polyoxyalkylene can be determined by dividing its molecular weight by the number of terminal terminal hydroxyl groups present. The number of terminal amine and hydroxyl groups can usually be determined from the structural formula of the polyoxyalkylene or empirically through well known procedures. The amide/acids and ester/acids formed by the reaction of the carboxylic agent and amine-terminated or hydroxy-terminated polyoxyalkylene can be neutralized with, for example, one or more alkali metals, one or more amines, or a mixture thereof, and thus converted to amide/salts or ester/salts, respectively. Additionally, if these amide/acids or ester/acids are added to concentrates or functional fluids containing alkali metals or amines, amide/salts or ester/salts usually form, in situ.

South African Patent 85/0978 is incorporated herein by reference for its teachings with respect to the use of hydrocarbyl-substituted succinic acid or anhydride/hydroxy-terminated poly(oxyalkylene) reaction products as thickeners for aqueous compositions.

When the thickener is formed using an amine-terminated poly(oxyalkylene), the thickening characteristics of said thickener can be enhanced by combining it with at least one surfactant. Any of the surfactants identified above under the subtitle "Surfactants" can be used in this regard. When such surfactants are used, the weight ratio of thickener to surfactant is generally in the range of from about 1:5 to about 5:1, preferably from about 1:1 to about 3:1.

Typically, the thickener is present in a thickening amount in the aqueous compositions of this invention. When used, the thickener is preferably present at a level of up to about 70% by weight, preferably from about 20% to about 50% by weight of the concentrates of the invention. The thickener is preferably present at a level in the range of from about 1.5% to about 10% by weight, preferably from about 3% to about 6% by weight of the functional fluids of the invention.

The functional additives that can be used in the aqueous systems are typically oil-soluble, water-insoluble additives which function in conventional oil-based systems as extreme pressure agents, anti-wear agents, load-carrying agents, dispersants, friction modifiers, lubricity agents, etc. They can also function as anti-slip agents, film formers and friction modifiers. As is well known, such additives can function in two or more of the above-mentioned ways; for example, extreme pressure agents often function as load-carrying agents.

The term "oil-soluble, water-insoluble functional additive" refers to a functional additive which is not soluble in water above a level of about 1 gram per 100 milliliters of water at 25° C., but is soluble in mineral oil to the extent of at least 1 gram per liter at 25° C.

These functional additives can also include certain solid lubricants such as graphite, molybdenum disulfide and polytetrafluoroethylene and related solid polymers.

These functional additives can also include frictional polymer formers. Briefly, these are potential polymer forming materials which are dispersed in a liquid carrier at low concentration and which polymerize at rubbing or contacting surfaces to form protective polymeric films on the surfaces. The polymerizations are believed to result from the heat generated by the rubbing and, possibly, from catalytic and/or chemical action of the freshly exposed surface. A specific example of such materials is linoleic acid and ethylene glycol combinations which can form a polyester frictional polymer film. These materials are known to the art and descriptions of them are found, for example, in the journal "Wear", Volume 26, pages 369–392, and West German Published Patent Application 2,339,065. These disclosures are hereby incorporated by reference for their discussions of frictional polymer formers.

Typically these functional additives are known metal or amine salts of organo sulfur, phosphorus, boron or carboxylic acids which are the same as or of the same type as used in oil-based fluids. Typically such salts are of carboxylic acids of 1 to 22 carbon atoms including both aromatic and aliphatic acids; sulfur acids such as alkyl and aromatic sulfonic acids and the like; phosphorus acids such as phosphoric acid, phosphorus acid, phosphinic acid, acid phosphate esters and analogous sulfur homologs such as the thiophosphoric and dithiophosphoric acid and related acid esters; boron acids include boric acid, acid borates and the like. Useful functional additives also include metal dithiocarbamates such as molybdenum and antimony dithiocarbamates; as well as dibutyl tin sulfide, tributyl tin oxide, phosphates and phosphites; borate amine salts, chlorinated waxes; trialkyl tin oxide, molybdenum phosphates, and chlorinated waxes.

Many such functional additives are known to the art. For example, descriptions of additives useful in conventional oil-based systems and in the aqueous systems of this invention are found in "Advances in Petroleum Chemistry and Refining", Volume 8, edited by John J. McKetta, Interscience Publishers, New York, 1963, pages 31–38 inclusive; Kirk-Othmer "Encyclopedia of Chemical Technology", Volume 12, Second Edition, Interscience Publishers, New York, 1967, page 575 et seq.; "Lubricant Additives" by M. W. Ranney, Noyes Data Corporation, Park Ridge, N.J., U.S.A., 1973; and "Lubricant Additives" by C. V. Smalheer and R. K. Smith, The Lezius-Hiles Co., Cleveland, Ohio, U.S.A. These references are hereby incorporated by reference for their disclosures of functional additives useful in the compositions of this invention.

In certain of the typical aqueous compositions of the invention, the functional additive is a sulfur or chlorosulfur extreme pressure agent, known to be useful in oil-base systems. Such materials include chlorinated aliphatic hydrocarbons, such as chlorinated wax; organic sulfides and polysulfides, such as benzyl-disulfide, bis-(chlorobenzyl)disulfide, dibutyl tetrasulfide, sulfurized sperm oil, sulfurized methyl ester of oleic acid, sulfurized alkylphenol, sulfurized dipentene, sulfurized terpene, and sulfurized Diels-Alder adducts; phosphosulfurized hydrocarbons, such as the reaction product of phosphorus sulfide with turpentine or methyl oleate; phosphorus esters such as the dihydrocarbon and trihydrocarbon phosphites, i.e., dibutyl phosphite, diheptyl phosphite, dicyclohexyl phosphite, pentylphenyl phosphite, dipentylphenyl phosphite, tridecyl phosphite, distearyl phosphite and polypropylene substituted phenol phosphite; metal thiocarbamates, such as zinc dioctyldithiocarbamate and barium heptylphenyl dithiocarbamate; and Group II metal salts of a phosphorodithioic acid, such as zinc dicyclohexyl phosphorodithioate.

The functional additive can also be a film former such as a synthetic or natural latex or emulsion thereof in water. Such latexes include natural rubber latexes and polystyrene butadienes synthetic latex.

The functional additive can also be an antichatter or anti-squawk agent. Examples of the former are the amide metal dithiophosphate combinations such as disclosed in West German Patent 1,109,302; amine salt-azomethine combinations such as disclosed in British Patent Specification 893,977; or amine dithiophosphate such as disclosed in U.S. Pat. No. 3,002,014. Examples of anti-squawk agents are N-acyl-sarcosines and derivatives thereof such as disclosed in U.S. Pat. Nos. 3,156,652 and 3,156,653; sulfurized fatty acids and esters thereof such as disclosed in U.S. Pat. Nos. 2,913,415 and 2,982,734; and esters of dimerized fatty acids such as disclosed in U.S. Pat. No. 3,039,967. The above-cited patents are incorporated herein by reference for their disclosure as pertinent to anti-chatter and anti-squawk agents useful as a functional additive in the aqueous systems of the present invention.

Specific examples of functional additives useful in the aqueous systems of this invention include the following commercially available products.

TABLE I

| Functional Additive Tradename | Chemical Description | Supplier |
|---|---|---|
| Anglamol 32 | Chlorosulfurized hydrocarbon | Lubrizol[1] |
| Anglamol 75 | Zinc dialkyl phosphate | Lubrizol[1] |
| Molyvan L | A thiaphosphomolybdate | Vanderbilt[2] |
| Lubrizol-5315 | Sulfurized cyclic carboxylate ester | Lubrizol[1] |
| Emcol TS 230 | Acid phosphate ester | Witco[3] |

[1]The Lubrizol Corporation, Wickliffe, Ohio, U.S.A.
[2]R. T. Vanderbilt Company, Inc., New York, N.Y., U.S.A.
[3]Witco Chemical Corp., Organics Division, Houston, Texas, U.S.A.

Mixtures of two or more of any of the afore-described functional additives can also be used.

Typically, a functionally effective amount of the functional additive is present in the aqueous compositions of this invention.

The term "functionally effective amount" refers to a sufficient quantity of an additive to impart desired properties intended by the addition of said additive. For example, if an additive is a rust-inhibitor, a functionally effective amount of said rust-inhibitor would be an amount sufficient to increase the rust-inhibiting characteristics of the composition to which it is added. Similarly, if the additive is an anti-wear agent, a functionally effective amount of said anti-wear agent would be a sufficient quantity of the anti-wear agent to improve the anti-wear characteristics of the composition to which it is added.

The aqueous systems of this invention often contain at least one inhibitor for corrosion of metals. These inhibitors can prevent corrosion of either ferrous or non-ferrous metals (e.g., copper, bronze, brass, titanium, aluminum and the like) or both. The inhibitor can be organic or inorganic in nature. Usually it is sufficiently soluble in water to provide a satisfactory inhibiting action though it can function as a corrosion-inhibitor without dissolving in water, it need not be water-soluble. Many suitable inorganic inhibitors useful in the aqueous systems of the present invention are known to those skilled in the art. Included are those described in "Protective Coatings for Metals" by Burns and Bradley, Reinhold Publishing Corporation, Second Edition, Chapter 13, pages 596–605. This disclosure relative to inhibitors are hereby incorporated by reference. Specific examples of useful inorganic inhibitors include alkali metal nitrites, sodium di- and tripolyphosphate, potassium and dipotassium phosphate, alkali metal borate and mixtures of the same. Many suitable organic inhibitors are known to those of skill in the art. Specific examples include hydrocarbyl amine and hydroxy-substituted hydrocarbyl amine neutralized acid compound, such as neutralized phosphates and hydrocarbyl phosphate esters, neutralized fatty acids (e.g., those having about 8 to about 22 carbon atoms), neutralized aromatic carboxylic acids (e.g., 4-tertiarybutyl benzoic acid), neutralized naphthenic acids and neutralized hydrocarbyl sulfonates. Mixed salt esters of alkylated succinimides are also useful. Particularly useful amines include the alkanol amines such as ethanol amine, diethanolamine. Mixtures of two or more of any of the afore-described corrosion-inhibitors can also be used. The corrosion-inhibitor is usually present in concentrations in which they are effective in inhibiting corrosion of metals with which the aqueous composition comes in contact.

Certain of the aqueous systems of the present invention (particularly those that are used in cutting or shaping of metal) can also contain at least one polyol with inverse solubility in water. Such polyols are those that become less soluble as the temperature of the water increases. They thus can function as surface lubricity agents during cutting or working operations since, as the liquid is heated as a result of friction between a metal workpiece and worktool, the polyol of inverse solubility "plates out" on the surface of the workpiece, thus improving its lubricity characteristics.

The aqueous systems of the present invention can also include at least one bactericide. Such bactericides are well known to those of skill in the art and specific examples can be found in the afore-mentioned McCutcheon publication "Functional Materials" under the heading "Antimicrobials" on pages 9–20 thereof. This disclosure is hereby incorporated by reference as it relates to suitable bactericides for use in the aqueous compositions or systems of this invention. Generally, these bactericides are water-soluble, at least to the extent to allow them to function as bactericides.

The aqueous systems of the present invention can also include such other materials as dyes, e.g., an acid green dye; water softeners, e.g., ethylene diamine tetraacetate sodium salt or nitrilo triacetic acid; odor masking agents, e.g., citronella, oil of lemon, and the like; and anti-foamants, such as the well-known silicone anti-foamant agents.

The aqueous systems of this invention may also include an anti-freeze additive where it is desired to use the composition at a low temperature. Materials such as ethylene glycol and analogous polyoxyalkylene polyols can be used as anti-freeze agents. Clearly, the amount used will depend on the degree of anti-freeze protection desired and will be known to those of ordinary skill in the art.

It should also be noted that many of the ingredients described above for use in making the aqueous systems of this invention are industrial products which exhibit or confer more than one property on such aqueous compositions. Thus, a single ingredient can provide several functions thereby eliminating or reducing the need for some other additional ingredient. Thus, for example, an extreme pressure agent such as tributyl tin oxide can also function as a bactericide.

While the invention has been explained in relation to its preferred embodiments it is to be understood that various modifications thereof will become apparent to those skilled in the art upon reading the specification. Therefore, it is to be understood that the invention disclosed herein is intended to cover such modifications as fall within the scope of the appended claims.

We claim:

1. A phosphorus- and/or nitrogen-containing derivative composition of sulfur-containing compounds prepared by the process comprising reacting:

(A) at least one sulfur composition selected from the group consisting of:

(A-1) compounds characterized by the structural formula

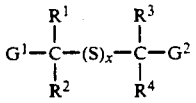

(I)

wherein $R^1$, $R^2$, $R^3$ and $R^4$ are each independently H or hydrocarbyl groups, or either or both of $R^1$ and $R^3$ is independently $G^1$ or $G^2$, or $R^1$ and $R^2$, or $R^3$ and $R^4$, together are alkylene groups containing about 4 to about 7 carbon atoms;

$G^1$ and $G^2$ are each independently selected from the group consisting of C(X)R, COOR, C═N, $R^5$—C═$NR^6$, $CON(R)_2$, and $NO_2$, wherein X is O or S, each of R and $R^5$ is independently H or a hydrocarbyl group, and $R^6$ is H or a hydrocarbyl group, or $G^1$ is $CH_2OH$;

when both $G^1$ and $G^2$ are $R^5$C═$NR^6$, the two $R^6$ groups together may be a hydrocarbylene group linking the two nitrogen atoms;

when $G^1$ is $CH_2OH$ and $G^2$ is COOR, a lactone may be formed by intramolecular combination of $G^1$ and $G^2$; and x is an integer from 1 to about 8; and (A-2) compositions prepared by reacting sulfur and/or sulfur halides with compounds represented by the structural formulae

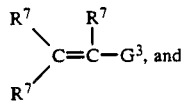

(II)

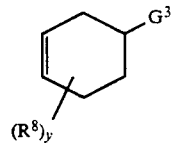

(II)

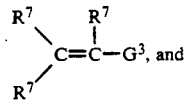

(II)

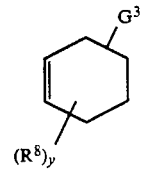

(III)

wherein each of $R^7$ is independently H or a hydrocarbyl group;

$R^8$ is H, a hydrocarbyl group, or a hydrocarbyloxy group;

$G^3$ is selected from the group consisting of C(X)R, C═N, COOR, $CON(R)_2$, $NO_2$, or $R^5$C═$NR^6$ wherein X, R, $R^5$ and $R^6$ are as defined above; and y is an integer from zero to 5; with (B) a composition selected from the group consisting of a di- or trihydrocarbyl phosphite, at least one amine compound containing at least one NH or $NH_2$ group, and a combination of said phosphite and amine, provided, however, when $G^1$ and $G^2$ in (A-1) are —C(X)R, (B) is a di- or trihydrocarbylphosphite or a mixture of said phosphite and an amine compound containing at least one NH or $NH_2$ group.

2. The composition of claim 1 wherein x is an integer from 1 to about 4.

3. The composition of claim 1 wherein $G^1$ and $G^2$ are identical.

4. The composition of claim 1 wherein $R^1$ and $R^3$ are H or hydrocarbyl groups and $G^1$ and $G^2$ are C(O)H.

5. The composition of claim 1 wherein $R^1$, $R^2$, $R^3$ and $R^4$ are hydrogen or hydrocarbyl groups, and both $G^1$ and $G^2$ are $NO_2$ groups.

6. The composition of claim 1 wherein $G^1$ and $G^2$ are C(X)R wherein R is a hydrocarbyl group.

7. The composition of claim 1 wherein $R^1$, $R^2$, $R^3$ and $R^4$ are each independently hydrogen or hydrocarbyl groups and $G^1$ and $G^2$ are both $R^5$—C═$NR^6$ groups wherein $R^5$ and $R^6$ are each independently hydrogen or hydrocarbyl groups or the two $R^6$ groups together form a hydrocarbylene group joining the two are hydrocarbyl nitrogen atoms.

8. The composition of claim 1 wherein $R^2$ and $R^4$ are hydrogen or hydrocarbyl groups and $R^1$, $R^3$, $G^1$ and $G^2$ are C(O)R wherein R is a hydrocarbyl group.

9. The composition of claim 1 wherein $R^2$ and $R^4$ are hydrogen or hydrocarbyl groups, $R^1$ and $R^3$ are COOR groups, and $G^1$ and $G^2$ are C(O)R groups wherein each R is hydrogen or a hydrocarbyl group.

10. The composition of claim 8 wherein each R is independently a hydrocarbyl group.

11. The composition of claim 1 wherein $R^1$, $R^2$, $R^3$ and $R^4$ are H or lower hydrocarbyl groups containing from 1 to about 7 carbon atoms.

12. The composition of claim 1 wherein the hydrocarbyl groups $R^7$ contain from 1 to about 7 carbon atoms.

13. The composition of claim 1 wherein $G^3$ is C(O)R.

14. The composition of claim 1 wherein $G^3$ is C≡N.

15. The composition of claim 1 wherein the compositions (A-2) are prepared by reacting sulfur with the compounds represented by structural formulae (II) and (III).

16. The composition of claim 1 wherein (B) is a di- or trihydrocarbyl phosphite represented by the structural formulae

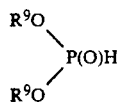

(Va)

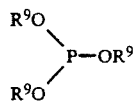

(Vb)

wherein each $R^9$ is independently a hydrocarbyl group.

17. The composition of claim 16 wherein the phosphite is represented by Formula Va and each $R^9$ is a hydrocarbyl group containing from 1 to about 24 carbon atoms.

18. The composition of claim 1 wherein the amine compound (B) is characterized by the formula $$R^{12}R^{13}NH \quad \text{(VI)}$$

wherein $R^{12}$ and $R^{13}$ are each independently hydrogen, hydrocarbyl, amino hydrocarbyl, or hydroxy hydrocarbyl groups.

19. The composition of claim 18 wherein $R^{12}$ is a hydrocarbyl group and $R^{13}$ is hydrogen.

20. The composition of claim 1 wherein $G^1$ and/or $G^2$ are C(X)R, and the sulfur composition (A) is reacted with a dihydrocarbyl phosphite, or a combination of said phosphite and a primary amine.

21. The composition of claim 1 prepared by reacting about one mole of sulfur composition (A-1) with at least about 2 moles of the di- or trihydrocarbyl phosphite.

22. The composition of claim 1 wherein about one mole of sulfur composition (A-1) is reacted with at least about one mole of a di- or trihydrocarbyl phosphite and one mole of at least one amine compound.

23. A phosphorus- and/or nitrogen-containing derivative composition of sulfur-containing compounds prepared by the process comprising reacting:

(A) at least one sulfur composition selected from the group consisting of (A-1) at least one sulfur composition characterized by the structural formula

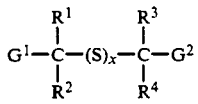

(I)

wherein $R^1$, $R^2$, $R^3$ and $R^4$ are each independently H or hydrocarbyl groups, or either or both of $R^1$ and $R^3$ is independently $G^1$ or $G^2$, or at least one of $R^1$ and $R^2$, or $R^3$ and $R^4$, together are alkylene groups containing about 4 to about 7 carbon atoms;

$G^1$ and $G^2$ are each independently selected from the group consisting of C(X)R, COOR, C≡N, $R^5$—C=$NR^6$, $CON(R)_2$, and $NO_2$, wherein X is O or S, each of R and $R^5$ is independently H or a hydrocarbyl group, and $R^6$ is H or a hydrocarbyl group, or $G^1$ is $CH_2OH$;

when both $G^1$ and $G^2$ are $R^5C{=}NR^6$, the two $R^6$ groups together may be a hydrocarbylene group linking the two nitrogen atoms;

when $G^1$ is $CH_2OH$ and $G^2$ is COOR, a lactone may be formed by intramolecular combination of $G^1$ and $G^2$; and x is an integer from 1 to about 8; with (B) a composition selected from the group consisting of at least one di- or trihydrocarbyl phosphite, at least one amine compound containing at least one NH or $NH_2$ group, and a combination of said phosphite and said amine, provided, however, when $G^1$ and $G^2$ in (A-1) are —C(X)R, (B) is a di- or trihydrocarbylphosphite or a mixture of said phosphite and an amine compound containing at least one NH or $NH_2$ group.

24. The composition of claim 23 wherein x is an integer of from 1 to about 4.

25. The composition of claim 23 wherein $G^1$ and $G^2$ are identical.

26. The composition of claim 23 wherein $G^1$ and $G^2$ are C(O)H.

27. The composition of claim 23 wherein $R^1$ and $R^3$ are H or hydrocarbyl groups and $G^1$ and $G^2$ are C(O)H.

28. The composition of claim 23 wherein the dihydrocarbyl phosphite is characterized by the formula

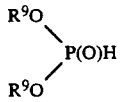

(Va)

wherein each $R^9$ is independently a hydrocarbyl group containing from 1 to about 24 carbon atoms.

29. The composition of claim 23 wherein the amine compound of (B) is a primary amine.

30. The composition of claim 23 wherein about one mole of the sulfur compound (A-1) is reacted with about 2 moles of a dihydrocarbyl phosphite.

31. The composition of claim 23 wherein about one mole of the sulfur compound (A-1) is reacted with about one mole of a dihydrocarbyl phosphite and about one mole of an amine compound.

32. The composition of claim 31 wherein the amine compound is a primary amine.

33. A composition comprising a mixture of the phosphorus and/or nitrogen derivative composition of claim 1 and (C) at least one carboxylic dispersant composition characterized by the presence within its molecular structure of (i) at least one polar group selected from the group consisting of acyl, acyloxy and hydrocarbylimidoyl groups and (ii) at least one group in which a nitrogen or oxygen atom is attached directly to said group (i), and said nitrogen or oxygen atom also is attached to a hydrocarbyl group.

34. A composition comprising a mixture of the phosphorus-, and/or nitrogen-derivative composition of claim 1 and (C) at least one carboxylic dispersant prepared by the reaction of a hydrocarbon-substituted succinic acid-producing compound with at least about one-half equivalent, per equivalent of acid-producing compound, of an organic hydroxy compound or an amine containing at least one hydrogen attached to a nitrogen atom, or a mixture of said hydroxy compound and amine.

35. The composition of claim 34 wherein the succinic acid-producing compound of (C) contains an average of at least about 50 aliphatic carbon atoms in the substituent.

36. The composition of claim 34 wherein the succinic acid-producing compound of (C) is selected from the group consisting of succinic acids, anhydrides, esters and halides.

37. The composition of claim 34 wherein the hydrocarbon substituent of the succinic acid-producing compound of (C) is derived from a polyolefin having an Mn value within the range of from about 700 to about 10,000.

38. The composition of claim 34 wherein the amine of (C) is characterized by the formula $$R^A R^8 NH$$

wherein $R^A$ and $R^8$ are each independently hydrogen, or hydrocarbon, amino-substituted hydrocarbon, hydroxy-substituted hydrocarbon, alkoxy-substituted hydrocarbon, amino, carbamyl, thiocarbamyl, guanyl, and acylimidoyl groups provided that only one of $R^A$ and $R^8$ may be hydrogen.

39. The composition of claim 34 wherein the amine of (C) is a polyamine.

40. The composition of claim 34 wherein the weight ratio of the composition of claim 1 to C is from about 0.1:1 to about 10:1.

41. The composition of claim 34 wherein (C) also contains boron and is prepared by the reaction of (C-1) at least one boron compound selected from the class consisting of boron trioxide, boron halides, boron acids, boron anhydrides, boron amides and esters of boron acids with (C-2) at least one carboxylic dispersant intermediate prepared by the reaction of a hydrocarbon-substituted succinic acid-producing compound with at least about one-half equivalent, per equivalent of acid producing compound, of an organic hydroxy compound or amine containing at least one hydrogen attached to a nitrogen atom, or a mixture of said hydroxy compound and amine.

42. The composition of claim 41 wherein the succinic acid-producing compound of (C-2) contains an average of at least about 50 aliphatic carbon atoms in the substituent.

43. The composition of claim 41 wherein the hydrocarbon substituent of the succinic acid-producing compound of (C-2) is derived from a polyolefin having an Mn value within the range of from about 700 to about 10,000.

44. The composition of claim 43 wherein the polyolefin is, a polyisobutene.

45. The composition of claim 41 wherein the amine of (C-2) is characterized by the formula $$R^A R^8 NH$$

wherein $R^A$ and $R^B$ are each independently hydrogen, or hydrocarbon, amino-substituted hydrocarbon, hydroxy-substituted hydrocarbon, alkoxy-substituted hydrocarbon, amino, carbamyl, thiocarbamyl, guanyl, and acylimidoyl groups, provided that only one of $R^A$ and $R^B$ may be hydrogen.

46. The composition of claim 41 wherein the amine of (C-2) is a polyamine.

47. The composition of claim 41 wherein the amine of (C-2) is an alkylene polyamine.

48. The composition of claim 41 wherein the amine of (C-2) is a hydroxyalkyl-substituted alkylene polyamine.

49. The composition of claim 41 wherein the boron compound of (C-1) is boric acid.

50. The composition of claim 41 wherein the amount of (C-1) and (C-2) present is an amount to provide from about 0.1 atomic proportion of boron for each mole of said carboxylic dispersant intermediate to about 10 atomic proportions of boron for each atomic proportion of nitrogen of said intermediate.

51. The composition of claim 34 wherein (C) also contains sulfur and is prepared by the reaction of carbon disulfide with (C-3) at least one soluble carboxylic dispersant intermediate prepared by the reaction of a hydrocarbon-substituted succinic acid-producing compound (acylating agent) with at least about one-half equivalent, per equivalent of acid-producing compound, of an amine containing at least one hydrogen attached to a nitrogen atom.

52. The composition of claim 34 wherein (C) also contains sulfur and is prepared by the reaction of carbon disulfide with (C-4) at least one dimercaptothiadiazole, and (C-2) at least one soluble carboxylic dispersant intermediate prepared by the reaction of a hydrocarbon-substituted succinic acid-producing compound (acylating agent) with at least about one-half equivalent, per equivalent of acid-producing compound, of an organic hydroxy compound or an amine containing at least one hydrogen attached to a nitrogen atom, or a mixture of said hydroxy compound and amine.

53. An additive concentrate for use in normally liquid fuels, lubricants or functional fluids comprising a substantially inert solvent/diluent and from about 30–90% of at least one composition of claim 1.

54. An additive concentrate for use in normally liquid fuels, lubricants or functional fluids comprising a substantially inert solvent/diluent and from about 30–90% of at least one composition of claim 23.

55. An additive concentrate for use in normally liquid fuels, lubricants or functional fluids comprising a substantially inert solvent/diluent and from about 30–90% of at least one composition of claim 34.

56. An additive concentrate for use in normally liquid fuels, lubricants or functional fluids comprising a substantially inert solvent/diluent and from about 30–90% of at least one composition of claim 41.

57. A lubricant or functional fluid composition comprising a major amount of at least one oil of lubricating viscosity and a minor amount of at least one composition of claim 1.

58. A lubricant or functional fluid composition comprising a major amount of at least one oil of lubricating viscosity and a minor amount of at least one composition of claim 23.

59. A lubricant or functional fluid composition comprising a major amount of at least one oil of lubricating viscosity and a minor amount of at least one composition of claim 34.

60. A lubricant or functional fluid composition comprising a major amount of at least one oil of lubricating viscosity and a minor amount of at least one composition of claim 41.

61. The composition of claim 57 wherein the lubricant or functional fluid is a lubricating oil or a grease.

62. The composition of claim 58 wherein the lubricant or functional fluid is a lubricating oil or a grease.

63. The composition of claim 60 wherein the lubricant or functional fluid is a lubricating oil or a grease.

64. A fuel composition comprising a major amount of a normally liquid fuel and a minor amount of at least one, composition of claim 1.

65. A fuel composition comprising a major amount of a normally liquid fuel and a minor amount of at least one composition of claim 23.

66. A fuel composition comprising a major amount of a normally liquid fuel and a minor amount of at least one composition of claim 34.

67. A fuel composition comprising a major amount of a normally liquid fuel and a minor amount of at least one composition of claim 41.

68. An aqueous system comprising at least about 40% of water and at least one composition of claim 1.

69. An aqueous system comprising at least about 40% of water and at least one composition of claim 23.

70. An aqueous system comprising at least about 40% of water and at least one composition of claim 34.

71. An aqueous system comprising at least about 40% of water and at least one composition of claim 41.

* * * * *